US009341971B2

(12) United States Patent
Mizoguchi et al.

(10) Patent No.: US 9,341,971 B2
(45) Date of Patent: May 17, 2016

(54) TONER, AND DEVELOPER AND IMAGE FORMING APPARATUS INCLUDING SAME

(71) Applicants: Yuka Mizoguchi, Shizuoka (JP); Hideki Sugiura, Shizuoka (JP); Mio Kumai, Shizuoka (JP)

(72) Inventors: Yuka Mizoguchi, Shizuoka (JP); Hideki Sugiura, Shizuoka (JP); Mio Kumai, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 33 days.

(21) Appl. No.: 14/338,614

(22) Filed: Jul. 23, 2014

(65) Prior Publication Data

US 2015/0072278 A1 Mar. 12, 2015

(30) Foreign Application Priority Data

Sep. 6, 2013 (JP) ..... 2013-185437

(51) Int. Cl.
*G03G 9/087* (2006.01)
*G03G 15/08* (2006.01)

(52) U.S. Cl.
CPC ..... *G03G 9/08788* (2013.01); *G03G 9/08724* (2013.01); *G03G 9/08755* (2013.01); *G03G 9/08795* (2013.01); *G03G 9/08797* (2013.01); *G03G 15/08* (2013.01)

(58) Field of Classification Search
CPC ..... G03G 9/08788; G03G 9/08797; G03G 9/08755
USPC ..... 430/109.4, 111.4
See application file for complete search history.

(56) References Cited

U.S. PATENT DOCUMENTS

2003/0039910 A1* 2/2003 Shirai ..... G03G 9/08755 430/109.4
2004/0152006 A1* 8/2004 Teshima ..... G03G 9/08755 430/109.4
2006/0057488 A1 3/2006 Inoue et al.
2012/0064447 A1 3/2012 Hozumi et al.
2013/0130167 A1* 5/2013 Hidaka ..... G03G 9/08755 430/109.4
2013/0260302 A1* 10/2013 Nakajima ..... G03G 9/08755 430/109.4

FOREIGN PATENT DOCUMENTS

JP 2002287426 A * 10/2002
JP 2006-084743 3/2006
JP 2006-145725 6/2006
JP 2007-233169 9/2007
JP 2012-063496 3/2012

OTHER PUBLICATIONS

English language machine translation of JP 2002-287426 (Oct. 2002).*

* cited by examiner

*Primary Examiner* — Christopher Rodee
(74) *Attorney, Agent, or Firm* — Oblon, McClelland, Maier & Neustadt, L.L.P.

(57) ABSTRACT

A toner comprised of toner particles including an amorphous resin and a crystalline resin is provided. The coefficient of variation in softening temperature among resin portions in the toner particles is 15% or less when the softening temperature is measured with a scanning probe microscope equipped with a heatable cantilever.

7 Claims, 4 Drawing Sheets

TONER, AND DEVELOPER AND IMAGE FORMING APPARATUS INCLUDING SAME

CROSS-REFERENCE TO RELATED APPLICATIONS

This patent application is based on and claims priority pursuant to 35 U.S.C. §119(a) to Japanese Patent Application No. 2013-185437, filed on Sep. 6, 2013, in the Japan Patent Office, the entire disclosure of which is hereby incorporated by reference herein.

BACKGROUND

1. Technical Field

The present disclosure relates to a toner, a developer, and an image forming apparatus.

2. Description of the Related Art

A typical electrophotographic image forming method includes the processes of forming an electrostatic latent image on a photoreceptor (an electrostatic latent image bearing member), developing the electrostatic latent image into a visible image (a toner image) with a developer, and transferring and fixing the visible image onto a recording medium such as paper.

Recently, to meet a requirement of energy saving, technologies for achieving low-temperature fixing have been developed. For example, toners which include low-softening-point resins and waxes having excellent low-temperature fixability have been proposed.

Although extremely-low-temperature fixable toners are technically available, such toners have a general drawback that they easily get solid by receiving heat from the machine in use or during storage. This phenomenon is generally called blocking. Such toners are poor at heat-resistant storage stability.

SUMMARY

In accordance with some embodiments, a toner is provided. The toner is comprised of toner particles including an amorphous resin and a crystalline resin. The coefficient of variation in softening temperature among resin portions in the toner particles is 15% or less when the softening temperature is measured with a scanning probe microscope equipped with a heatable cantilever.

In accordance with some embodiments, a developer is provided. The developer includes the above toner.

In accordance with some embodiments, an image forming apparatus is provided. The image forming apparatus includes an electrostatic latent image bearing member, a charger, an irradiator, a developing device, a transfer device, and a fixing device. The charger charges a surface of the electrostatic latent image bearing member. The irradiator irradiates the charged surface of the electrostatic latent image bearing member with light to form an electrostatic latent image. The developing device develops the electrostatic latent image into a visible image with the above developer. The transfer device transfers the visible image onto a recording medium. The fixing device fixes the transferred image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
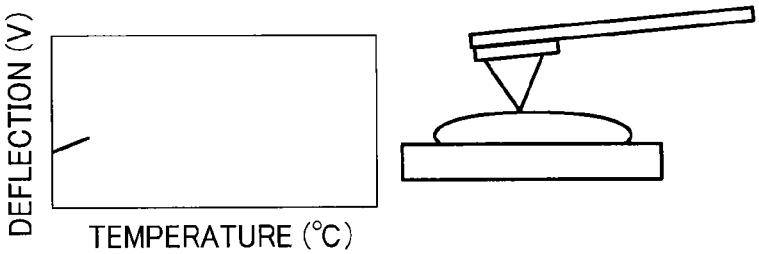
FIGS. 1A to 1C are schematic views illustrating procedures for measuring softening temperature of resin portions in toner particles with an SPM equipped with a heatable cantilever.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

One object of the present invention is to provide a toner having low-temperature fixability and heat-resistant storage stability and capable of forming high-quality image without gloss unevenness; and a developer, an image forming apparatus, and an image forming method using the above toner.

The inventors of the present invention have discovered that a toner comprised of toner particles including an amorphous resin and a crystalline resin in which a coefficient of variation in softening temperature among resin portions in the toner particles is 15% or less provides a toner having low-temperature fixability and heat-resistant storage stability and capable of forming high-quality image without gloss unevenness, as well as a developer, an image forming apparatus, and an image forming method using this toner.

Although the mechanism is still being elucidated, several analysis data have led to the following assumptions.

Based on an assumption that, to melt the toner at low temperatures, it is important that the crystalline resin is capable of effectively plasticizing (i.e., melting at low temperatures) the surrounding amorphous resin, it is extremely preferable that the crystalline resin is dispersed in the state of micro dispersion, not macro dispersion. By keeping the coefficient of variation in softening temperature among resin portions in the toner particles to 15% or less, the crystalline resin can be dispersed in the state of micro dispersion and melting properties get almost uniform inside and among the toner particles. Thus, the toner can effectively melt at low temperatures while providing high-quality images. When the crystalline resin is dispersed in the state of macro dispersion and its dispersibility is uneven both inside and among the toner particles, the coefficient of variation in softening temperature will exceed 15% and melting property will be distributed. The fixed image will be uneven in gloss and worsened in image quality. To achieve a balance between low-temperature melting property and image quality at a much higher level, it is preferable that the coefficient of variation in softening temperature is 10% or less.

Accordingly, a toner comprised of toner particles including an amorphous resin and a crystalline resin in which a coefficient of variation in softening temperature among resin portions in the toner particles is 15% or less is provided. The softening temperature is measured with a scanning probe microscope (hereinafter "SPM") equipped with a heatable cantilever.

It is understood from the following detail and specific descriptions that, according to some embodiments of the present invention, a toner which has low-temperature fixability and heat-resistant storage stability and is capable of forming high-quality image without gloss unevenness; and a developer, an image forming apparatus, and an image forming method using the above toner are provided.

According to an embodiment, the average length of the long axis of each crystalline resin portion in each toner particle is preferably from 50 to 300 nm in view of low-temperature fixability and heat-resistant storage stability. When the average length of the long axis of each crystalline resin portion is less than 50 nm, it is highly probable that plasticization will progress even when the toner is not heated, causing toner blocking. When the average length of the long axis of each crystalline resin portion exceeds 300 nm, the contact area between the crystalline and amorphous resins is reduced to lower the plasticization efficiency, which is not effective for low-temperature fixing.

Moreover, the crystalline resin itself may cause aggregation of crystalline resin blocks to lower heat-resistant storage stability of the toner that is in powdery state.

According to an embodiment, the endothermic quantity of the crystalline resin is preferably from 5 to 15 J/g in view of low-temperature fixability. When the endothermic quantity is less than 5 J/g, it means that the crystalline resin is excessively compatibilized with the amorphous resin and any crystalline component exists no more. Thus, plasticization of the amorphous resin will progress and heat-resistant storage stability will worsen, which is not preferable. When the endothermic quantity exceeds 15 J/g, it means that the crystalline state is sufficient for giving low-temperature fixability to the toner. However, decline in toner fluidity will be caused presumably due to decline in hardness of the crystalline resin.

It has been very difficult to achieve a uniform micro dispersion state of the crystalline resin in the toner only by means of adjusting dispersion conditions for the amorphous and crystalline resins and post-heat treatment conditions for the resulting mother particles. As an approach for achieving a uniform micro dispersion state of the crystalline resin in the toner, according to an embodiment, it is preferable that the toner includes a block copolymer resin having an amorphous polyester unit (A) and a crystalline polyester unit (C) as the third resin.

This makes it easier to achieve a uniform micro dispersion state of the crystalline resin in the toner. Having combined characteristics of the amorphous and crystalline resins, the block copolymer resin has good compatibility with both of the resins and enables the crystalline resin to be uniformly dispersed in the toner.

According to an embodiment, the mass ratio ((A)/(C)) of the amorphous polyester unit (A) to the crystalline polyester unit (C) is preferably from 90/10 to 60/40. The higher the ratio of the amorphous resin in the block copolymer resin becomes, the easier it becomes to disperse the crystalline resin in the amorphous resin in the state of micro dispersion.

According to an embodiment, the block copolymer resin preferably has urethane and/or urea bonds. This makes it easier to bind the amorphous polyester unit (A) and the crystalline polyester unit (C) together.

According to another embodiment, the toner is produced by a dissolution suspension method. In this embodiment, the toner can be designed to have low-temperature fixability and its particle shape becomes more properly controllable. Because the particle shape has an effect on toner fluidity, decline in toner fluidity can be prevented even under high-temperature and high-humidity environment.

According to an embodiment, a two-component developer including the above toner and a magnetic carrier is provided. In this embodiment, toner fluidity can be kept in an appropriate range even under high temperature and high humidity environment and developing members are less contaminated through the developing and transferring processes. According to this embodiment, a two-component developer with high environmental stability and reliability can be provided. According to another embodiment, and image forming apparatus including the above developer is also provided.

Evaluation of Variation in Softening Temperature with SPM

In the present disclosure, softening temperature is preferably evaluated with an SPM equipped with a heatable cantilever in the below-described manner (hereinafter referred to as "nano-TA"). However, the evaluation procedure can be replaced with any other method which has been confirmed to deliver the same result.

Figure 1B:
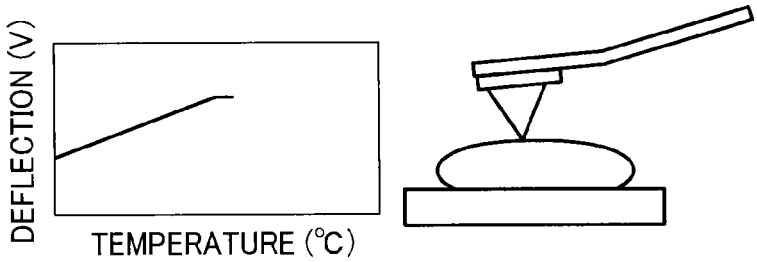
Figure 1C:
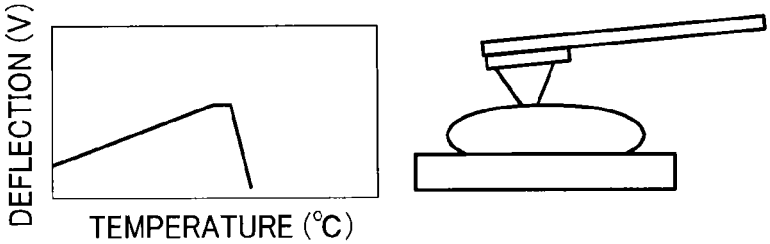

The nano-TA here refers to a method for evaluating softening characteristics of samples with an SPM equipped with a heatable cantilever. The cantilever is moved to the measurement position to be brought into contact with a sample and then heated. As the cantilever is heated, the sample is thermally expanded to deflect the cantilever. Upon reaching a certain temperature, such as melting point or softening temperature of the sample, the cantilever starts to sink into the sample. The inflection point as to the deflection of the cantilever is regarded as the softening temperature of the sample as shown in FIGS. 1A to 1C.

The nano-TA uses a dedicated acute cantilever which is capable of evaluating softening characteristics in micro regions with a size of several tens to hundreds nanometers. The temperature of the cantilever is calibrated in advance using three standard resins whose softening temperatures are already given.

Detailed evaluation method is described below. First, a toner is embedded in an epoxy resin and the resin is hardened. The hardened resin is cut with an ultramicrotome (ULTRACUT UCT from Leica equipped with a diamond knife) to create a cross-sectional sample of the toner. The cross-sectional sample of the toner is subjected to the nano-TA evaluation.

Ten or more points within binder resin portions (or within amorphous resin portions if crystalline resin portions and amorphous resin portions are distinguishable from each other) in one toner particle are subjected to measurement of softening temperature. Twenty or more toner particles are subjected to the above measurement of softening temperature.

Coefficient of variation (C.V.) is calculated from the average value and standard deviation of the softening temperature as follows.

$$\text{Coefficient of variation (C.V.)} = \text{Standard deviation} / \text{Average value} \quad (1)$$

SPM instrument: MFP-3D intermolecular force probe microscope system (from Asylum Research)

Measurement mode: Deflection Ztherm (Ramp Rate: 0.1)

Cantilever: AN2-200

Evaluation of Length of Long Axis of Crystalline Resin Portion

In the present disclosure, the length of the long axis of the crystalline resin portion is preferably evaluated with TEM (transmission electron microscope) in the following manner.

First, a toner is embedded in an epoxy resin and the epoxy resin is hardened. The hardened resin is cut into ultrathin sections (having a thickness of 80 nm) with an ultramicrotome (ULTRACUT UCT from Leica equipped with a diamond knife). The ultrathin sections are exposed to a gas of ruthenium tetraoxide, osmium tetraoxide, or another dying agent so that the crystalline resin portions are distinguishable from other portions. The exposure time is adjusted according to the contrast observed. The ultrathin sections are observed with a TEM (transmission electron microscope JEM-2100 from JEOL Ltd.) at an accelerating voltage of 100 kV. If the crystalline resin portion and the amorphous resin portion are distinguishable from each other without dying, dying is unnecessary. Composition contrast may be given by another pre-treatment, such as selective etching, prior to the TEM observation. The observed TEM image is subjected to a binarization process etc., with a commercially-available image processing software (e.g., Image-ProPlus), to calculate the length of the long axis of the crystalline resin portion. In the calculation, preferably, 50 or more of the crystalline resin portions are subjected to the analysis from a quantitative analysis perspective.

Evaluation of DSC Endothermic Quantity

In the present disclosure, DSC endothermic quantity is preferably measured in the following manner.

Measurement can be performed by, for example, temperature-modulated DSC such as a differential scanning calorimeter Q200 (from TA Instruments). First, about 5.0 mg of toner is put in an aluminum sample container. The container is put on a holder unit and set in an electric furnace.

Under nitrogen atmosphere, the sample is heated from 0 to 150° C. at a heating rate of 3° C./min and a modulation cycle of 0.5° C./60 sec to obtain a DSC curve in the 1st heating. The DSC endothermic quantity is determined from "Total Heat Flow" calculated by analyzing the DSC curve with an analysis program TA Universal Analysis (from TA Instruments).

In general, evaluation of endothermic quantity and glass transition temperature of resins are made with the results obtained in the 2nd heating that is a reheating performed after the 1st heating and subsequent cooling. This is because various manufacturing histories given to the resins are canceled in the 1st heating and inherent characteristics of the resins are evaluated in the 2nd heating. By contrast, in the present disclosure, to capture the behavior of the toner during heat-melting process, the above evaluation can be properly made with the results obtained in the 1st heating. Specifically, use of temperature-modulated DSC makes it possible to more precisely evaluate the DSC curve in the 1st heating to more accurately evaluate compatibility of the crystalline resin with the amorphous resin.

Binder Resin

According to an embodiment, the binder resin preferably includes a block copolymer resin having an amorphous polyester unit (A) and a crystalline polyester unit (C) as well as a crystalline resin.

Block Copolymer Resin

The block copolymer resin is defined as a copolymer resin having a structural unit derived from a crystalline segment and another structural unit derived from an amorphous segment. (The "block copolymer resin" may be hereinafter referred to as "copolymer resin" for the sake of simplicity.)

Use of the block copolymer resin enables formation of a specific higher order structure as represented by microphase separation structure.

The block copolymer resin is a resin in which heterogeneous polymer chains are bound together with covalent bonds. Generally, in most cases, heterogeneous polymer chains are incompatible with each other. They are not to mingle with each other like water and oil. In a simple mixed system of heterogeneous polymer chains, each of the polymer chains are independently movable to allow homogeneous polymer chains gather and macrophase-separate from the other polymer chains. In the copolymer resin, by contrast, heterogeneous polymer chains are bound together to prevent homogeneous polymer chains from gathering and phase-separating from the other polymer chains.

There is no limit in the kind of crystalline resin for constituting the crystalline segment of the block copolymer resin, but crystalline polyester resins are preferable.

Production of Block Copolymer Resin

Production method of the block copolymer resin is not limited to any particular method. For example, the block copolymer resin can be produced by the following methods (1) to (3). From the viewpoint of the degree of freedom in molecular design, (1) and (3) are preferable and (1) is more preferable.

(1) A method in which an amorphous resin prepared by a polymerization reaction and a crystalline resin prepared by a polymerization reaction are dissolved or dispersed in a solvent and allowed to react with an elongation agent having 2 or more functional groups reactive with terminal hydroxyl or carboxylic group of polymer chain, such as isocyanate group, epoxy group, and carbodiimide group.

(2) A method in which an amorphous resin prepared by a polymerization reaction and a crystalline resin prepared by a polymerization reaction are melt-kneaded and subjected to an ester exchange reaction under reduced pressures.

(3) A method in which a crystalline resin and an amorphous resin are copolymerized by initiating a ring-opening polymerization of the amorphous resin from a polymer chain terminal of the crystalline resin while hydroxyl groups in the crystalline resin act as polymerization initiator.

As the elongation agent, polyisocyanate is preferable. Specific examples of polyisocyanate include, but are not limited to, diisocyanate.

Specific examples of diisocyanate include, but are not limited to, aromatic diisocyanate, aliphatic diisocyanate, alicyclic diisocyanate, and aromatic aliphatic diisocyanate.

Specific examples of aromatic diisocyanate include, but are not limited to, 1,3-phenylene diisocyanate, 1,4-phenylene diisocyanate, 2,4-tolylene diisocyanate (TDI), 2,6-tolylene diisocyanate (TDI), crude TDI, 2,4'-diphenylmethane diisocyanate (MDI), 4,4'-diphenylmethane diisocyanate (MDI), crude MDI, 1,5-naphthylene diisocyanate, 4,4',4"-triphenylmethane triisocyanate, m-isocyanatophenylsulfonyl isocyanate, and p-isocyanatophenylsulfonyl isocyanate.

Specific examples of aliphatic diisocyanate include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanato hexanoate.

Specific examples of alicyclic diisocyanate include, but are not limited to, isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanoethyl)-4-cyclohexene-1,2-dicarboxylate, 2,5-norbornane diisocyanate, and 2,6-norbornane diisocyanate.

Specific examples of aromatic aliphatic diisocyanate include, but are not limited to, m-xylylene diisocyanate (XDI), p-xylylene diisocyanate (XDI), and α,α,α',α'-tetramethylxylylene diisocyanate (TMXDI).

Crystalline Resin

According to an embodiment, the binder resin includes a crystalline resin together with the block copolymer resin.

The crystalline resin prevents compatibilization of the crystalline and amorphous segments in the block copolymer resin, even when their compatibility is so high that crystallinity is easy to reduce, to maintain sufficient crystallinity of the binder resin.

The crystalline resin is not limited in the structure, but crystalline polyester resins are preferable.

Crystalline Polyester Resin

The crystalline polyester resin is obtainable from a polyol component and a polycarboxylic acid component such as polycarboxylic acid, polycarboxylic acid anhydride, and polycarboxylic acid ester.

In the present disclosure, the crystalline polyester resin is defined as a resin obtained from a polyol component and a polycarboxylic acid component such as polycarboxylic acid, polycarboxylic acid anhydride, and polycarboxylic acid ester. Modified polyester resins, such as a polyester prepolymer (to be described later) and a modified polyester resin obtained by cross-linking and/or elongating the polyester prepolymer, are not included in the crystalline polyester resin.

Specific examples of the polyol component include, but are not limited to, saturated aliphatic diol compounds having 2 to 12 carbon atoms. Specific examples of the saturated aliphatic diol compounds having 2 to 12 carbon atoms include, but are not limited to, 1,4-butanediol, 1,6-hexanediol, 1,8-octanediol, 1,10-decanediol, and 1,12-dodecanediol.

Specific examples of the polycarboxylic acid component include, but are not limited to, dicarboxylic acids having C=C double bonds and 2 to 12 carbon atoms, saturated dicarboxylic acids having 2 to 12 carbon atoms, and derivatives thereof. Specific examples of such compounds include, but are not limited to, fumaric acid, 1,4-butanedioic acid, 1,6-hexanedioic acid, 1,8-octanedioic acid, 1,10-decanedioic acid, 1,12-dodecanedioic acid, and derivatives thereof.

There is no limit in the method of controlling crystallinity and softening temperature of the crystalline polyester resin. For example, a desired crystalline resin can be obtained by a proper molecular design of a nonlinear polyester.

Production method of the nonlinear polyester is not limited to any particular method. For example, it can be produced by a polycondensation of the polyol component including a polyol having 3 or more valences, such as glycerin, with the polycarboxylic acid component including a polycarboxylic acid having 3 or more valences, such as trimellitic anhydride.

Molecular structure of the crystalline polyester resin can be determined by solid NMR.

The crystalline polyester resin is not limited in acid value. To achieve a desired level of low-temperature fixability in view of affinity of the crystalline polyester resin for recording media, the acid value is preferably 5 mgKOH/g or more and more preferably 10 mgKOH/g or more. On the other hand, to improve hot offset resistance, the acid value is preferably 45 mgKOH/g or less.

Acid value can be measured in compliance with the method according to JIS K0070-1992. Specifically, the method includes a titration with N/10 potassium hydroxide alcohol solution standardized in advance. Acid value is calculated from the consumed amount (KOH (mL)) of the potassium hydroxide alcohol solution in the titration according to the following formula (2).

$$\text{Acid value}=\text{KOH (mL)}\times N\times 56.1/M \quad (2)$$

In the formula (2), N represents the factor of the potassium hydroxide alcohol solution and M represents the mass of a sample.

The crystalline polyester resin is not limited in hydroxyl value. To achieve a desired level of low-temperature fixability and excellent charging characteristics, the hydroxyl value is preferably from 0 to 50 mgKOH/g and more preferably from 5 to 50 mgKOH/g.

Hydroxyl value can be measured in compliance with the method according to JIS K0070-1992. First, 0.5 g of a sample is precisely weighed in a 100-mL measuring flask and 5 mL of an acetylating reagent is further added thereto. The flask is heated in a bath at 100±5° C. After 1 to 2 hours of heating, the flask is taken out of the bath and left to cool. The flask is then charged with water and shaken well so that the produced acetic acid is decomposed. To complete the decomposition, the flask is heated again in the bath for at least 10 minutes and left to cool. The wall of the flask is well washed with an organic solvent. The resulting liquid is subjected to a potentiometric titration with N/2 potassium hydroxide ethyl alcohol solution to determine hydroxyl value (in compliance with the method according to JIS K0070-1966).

The crystalline polyester resin is not limited in melting point. In a differential thermal curve obtained by differential scanning calorimetry (hereinafter "DSC"), a temperature at an endothermic peak having a local maximum endothermic quantity (hereinafter "local maximum endothermic peak temperature") represents the melting point, and is preferably from 50 to 150° C. When the melting point is less than 50° C., heat-resistant storage stability of the toner worsens, i.e., the toner may get solidified to reduce fluidity. When the melting point exceeds 150° C., release agent cannot be finely dispersed at the time of fixing. As a result, the fixed image surface is poor at releasability and will be contaminated with the release agent, causing gloss unevenness and solid image surface roughness.

Amorphous Resin

According to an embodiment, the binder resin includes an amorphous resin together with the crystalline resin and the block copolymer resin. The amorphous resin is no limited in the structure, but amorphous polyester resins are preferable.

Specific examples of amorphous polyester resin include, but are not limited to, unmodified polyester resins and modified polyester resins.

Unmodified Polyester Resin

The unmodified polyester resin is an amorphous polyester resin and is obtainable from a polyol component and a polycarboxylic acid component such as polycarboxylic acid, polycarboxylic acid anhydride, and polycarboxylic acid ester.

Specific examples of the polyol components include, but are not limited to, alkylene (with a carbon number of 2 to 3) oxide adducts (with an average addition mole number of 1 to 10) of bisphenol A such as polyoxypropylene(2.2)-2,2-bis(4-hydroxyphenyl)propane, polyoxyethylene(2.2)-2,2-bis(4-hydroxyphenyl)propane; and ethylene glycol, propylene glycol, neopentyl glycol, glycerin, pentaerythritol, trimethylolpropane, hydrogenated bisphenol A, sorbitol, and alkylene (with a carbon number of 2 to 3) oxide adducts (with an average addition mole number of 1 to 10) of these compounds. These compounds can be used alone or in combination.

Specific examples of the polycarboxylic acid components include, but are not limited to, dicarboxylic acids such as adipic acid, phthalic acid, isophthalic acid, terephthalic acid, fumaric acid, and maleic acid; succinic acids substituted with an alkyl group having a carbon number of 1 to 20 or an alkenyl group having a carbon number of 2 to 20, such as dodecenyl succinic acid and octyl succinic acid; trimellitic acid and pyromellitic acid; and anhydrides and alkyl (with a carbon number of 1 to 8) esters of the above acids. These compounds can be used alone or in combination.

It is preferable that the unmodified polyester resin, a polyester prepolymer (to be described later), and a modified polyester resin obtained by cross-linking and/or elongating the polyester prepolymer are at least partially compatibilized with each other. Such a compatibilization makes improvements in low-temperature fixability and high-temperature offset resistance. Therefore, it is preferable that polyol and polycarboxylic acid components constituting the unmodified polyester resin and those constituting the prepolymer are similar in composition.

The unmodified polyester resin is not limited in molecular weight. When the molecular weight is too low, heat-resistant storage stability and resistance to stress, such as that arising from agitation in developing device, of the toner may worsen. When the molecular weight is too high, viscoelasticity of the toner becomes too high when the toner is melted, degrading low-temperature fixability. For the above reasons, it is preferable that the weight average molecular weight (Mw) is from 2,500 to 10,000, the number average molecular weight (Mn) is from 1,000 to 4,000, and Mw/Mn is from 1.0 to 4.0 when measured by gel permeation chromatography (GPC).

It is more preferable that the weight average molecular weight (Mw) is from 3,000 to 6,000, the number average molecular weight (Mn) is from 1,500 to 3,000, and Mw/Mn is from 1.0 to 3.5.

The acid value of the unmodified polyester resin is not limited to any particular value but is preferably from 1 to 50 mgKOH/g and more preferably from 5 to 30 mgKOH/g. When the acid value exceeds 1 mgKOH/g, the toner is easily negatively chargeable and has better affinity for paper, improving low-temperature fixability. When the acid value exceeds 50 mgKOH/g, charging stability, especially charging stability in environmental variation, may worsen.

The hydroxyl value of the unmodified polyester resin is not limited to any particular value but is preferably 5 mgKOH/g or more.

Modified Polyester Resin

The modified polyester resin is not limited in the structure but preferably includes a compound having an active hydrogen group and a polyester resin having a functional group reactive with the active hydrogen group.

Compound Having Active Hydrogen Group

The compound having an active hydrogen group acts as an elongation and/or cross-linking agent when the polyester resin having a functional group reactive with the compound having an active hydrogen group is subjected to an elongation and/or cross-linking reaction in an aqueous medium.

The compound having an active hydrogen group is not limited in the structure so long as an active hydrogen group exists. For example, when the polyester resin having a functional group reactive with the compound having an active hydrogen group is a polyester prepolymer (A) having an isocyanate group, an amine (B) is preferable as the compound having an active hydrogen group because the amine (B) is capable of elongating and/or cross-linking with the polyester prepolymer (A) having an isocyanate group to produce a polymer.

The active hydrogen group may be, for example, a hydroxyl group (e.g., an alcoholic hydroxyl group, a phenolic hydroxyl group), an amino group, a carboxyl group, or a mercapto group. These compounds can be used alone or in combination.

The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked. These compounds can be used alone or in combination.

A diamine (B1) alone and a mixture of a diamine (B1) with a small amount of a polyamine (B2) having 3 or more valences are preferable.

Specific examples of the diamine (B1) include, but are not limited to, aromatic diamine, alicyclic diamine, and aliphatic diamine. Specific examples of the aromatic diamine include, but are not limited to, phenylenediamine, diethyltoluenediamine, and 4,4'-diaminodiphenylmethane. Specific examples of the alicyclic diamine include, but are not limited to, 4,4'-diamino-3,3'-dimethyldicyclohexylmethane, diaminocyclohexane, and isophoronediamine. Specific examples of the aliphatic diamine include, but are not limited to, ethylenediamine, tetramethylenediamine, and hexamethylenediamine.

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

Polyester Resin Having Functional Group Reactive with Compound Having Active Hydrogen Group The polyester resin having a functional group reactive with the compound having an active hydrogen group is not limited in the structure so long as the polyester resin includes a site reactive with the compound having an active hydrogen group.

Specific examples of the functional group reactive with the compound having an active hydrogen group include, but are not limited to, isocyanate group, epoxy group, carboxy group, and acid chloride group. These groups can be included alone or in combination. Among these groups, isocyanate group is most preferable as the functional group reactive with the compound having an active hydrogen group.

Production method of the polyester prepolymer (A) having an isocyanate group is not limited to any particular method. According one example of the production method, the polyester prepolymer (A) can be produced by heating a polyol (A1) and a polycarboxylic acid (A2) to between 150 and 280° C. in the presence of an esterification catalyst (e.g., tetrabutoxy titanate, dibutyltin oxide) while reducing pressure, if necessary; removing by-product water to obtain a polyester having a hydroxyl group; and allowing the polyester having a hydroxyl group to react with a polyisocyanate (A3) at 40 to 140° C.

Specific examples of the polyol (A1) include, but are not limited to, a diol, a polyol having 3 or more valences, and a mixture of a diol with a polyol having 3 or more valences. These compounds can be used alone or in combination. Sole use of a diol or combination use of a diol with a small amount of a polyol having 3 or more valences is preferable.

Specific examples of the diol include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the alicyclic diols; and alkylene oxide (e.g., ethylene oxide, propylene oxide, butylene oxide) adducts of the bisphenols. These compounds can be used alone or in combination.

Among these compounds, alkylene glycols having 2 to 12 carbon atoms and alkylene oxide adducts of bisphenols (e.g., ethylene oxide 2 mol adduct of bisphenol A, propylene oxide 2 mol adduct of bisphenol A, propylene oxide 3 mol adduct of bisphenol A) are preferable.

Specific examples of the polyol having 3 or more valences include, but are not limited to, polyvalent aliphatic alcohols (e.g., glycerin, trimethylolethane, trimethylolpropane, pentaerythritol, sorbitol), polyphenols having 3 or more valences (e.g., phenol novolac, cresol novolac), and alkylene oxide adducts of the polyphenols having 3 or more valences. These compounds can be used alone or in combination.

With respect to a mixture of a diol with a polyol having 3 or more valences, there is no limit in mixing mass ratio between the diol and the polyol having 3 or more valences. The mixing mass ratio (diol:polyol having 3 or more valences) is preferably from 100:0.01 to 100:10 and more preferably from 100:0.01 to 100:1.

Specific examples of the polycarboxylic acid (A2) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., terephthalic acid, isophthalic acid, naphthalenedicarboxylic acid). These compounds can be used alone or in combination. Among these compounds, alkenylene dicarboxylic acids having 4 to 20 carbon atoms and aromatic dicarboxylic acids having 8 to 20 carbon atoms are preferable.

Specific examples of polycarboxylic acid having 3 or more valences include, but are not limited to, aromatic polycarboxylic acids having 9 to 20 carbon atoms (e.g., trimellitic acid, pyromellitic acid). These compounds can be used alone or in combination.

In addition, anhydrides and lower alkyl esters of polycarboxylic acids can be used in place of polycarboxylic acids. Specific examples of the lower alkyl esters include, but are not limited to, methyl ester, ethyl ester, and isopropyl ester.

Specific examples of the polyisocyanate (A3) include, but are not limited to, aliphatic polyisocyanates, alicyclic polyisocyanates, aromatic diisocyanates, aromatic aliphatic diisocyanates, isocyanurates, and the above polyisocyanates in which the isocyanate group is blocked with a phenol derivative, an oxime, or a caprolactam.

Specific examples of the aliphatic polyisocyanates include, but are not limited to, tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

Specific examples of the alicyclic polyisocyanates include, but are not limited to, isophorone diisocyanate and cyclohexylmethane diisocyanate.

Specific examples of the aromatic diisocyanates include, but are not limited to, tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate.

Specific examples of the aromatic aliphatic diisocyanates include, but are not limited to, $\alpha,\alpha,\alpha',\alpha'$-tetramethylxylylene diisocyanate.

Specific examples of the isocyanurates include, but are not limited to, trisisocyanatoalkyl isocyanurate and triisocyanatocycloalkyl isocyanurate.

These compounds can be used alone or in combination.

The average number of isocyanate groups included in one molecule of the polyester prepolymer (A) having an isocyanate group is typically 1 or more, preferably from 1.2 to 5, and more preferably from 1.5 to 4.

When the average number of isocyanate groups per molecule is less than 1, the molecular weight of the modified polyester is lowered to degrade hot offset resistance and storage stability.

The modified polyester resin can be obtained by reacting the compound having an active hydrogen group, such as the amine (B), with the polyester resin having a functional group reactive with the compound having an active hydrogen group, such as the polyester prepolymer (A), in an aqueous medium.

When the polyisocyanate (A3) reacts with the amine (B), a solvent can be used if necessary.

Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive against isocyanates. These solvents can be used alone or in combination.

To terminate elongation and/or cross-linking reaction between the compound having an active hydrogen group and the polyester resin having a functional group reactive with the compound having an active hydrogen group, a reaction terminator can be used.

Specific examples of the reaction terminator include, but are not limited to, monoamines (e.g., diethylamine, dibutylamine, butylamine, laurylamine) and blocked monoamines (e.g., ketimine compounds). These compounds can be used alone or in combination.

Other Components

The toner may further include any other components such as release agent, charge controlling agent, external additive, fluidity improving agent, cleanability improving agent, and magnetic material.

Resin Fine Particle

There is no limit in the kind of resin used for resin fine particle. Specific examples of usable resins include, but are not limited to, vinyl resin, polyurethane resin, epoxy resin, polyester resin, polyamide resin, polyimide resin, silicone resin, phenol resin, melamine resin, urea resin, aniline resin, ionomer resin, and polycarbonate resin. Among these resins, vinyl resin, polyurethane resin, epoxy resin, polyester resin, and combinations thereof are preferable, and vinyl resin is most preferable, because aqueous dispersions of fine spherical particles thereof are easily obtainable.

Specific examples of the vinyl resin include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

In addition, copolymers composed of monomers having at least two unsaturated groups are also usable for the resin fine particle.

Specific examples of the monomers having at least two unsaturated groups include, but are not limited to, sodium salt of sulfuric acid ester of ethylene oxide adduct of methacrylic acid (ELEMINOL RS-30 from Sanyo Chemical Industries, Ltd.), divinylbenzene, and 1,6-hexanediol acrylate.

The resin fine particle is preferably included in the shell layer of the toner.

The volume average particle diameter of the resin fine particle is preferably from 120 to 670 nm and more preferably from 200 to 600 nm. When the volume average particle diameter is less than 120 nm, the shell layer becomes much thinner and a core-shell structure cannot be well formed. When the volume average particle diameter exceeds 670 nm, the thickness of the shell layer becomes much thicker and the toner cannot exert low-temperature fixability well.

The volume average particle diameter can be measured with a particle size distribution analyzer LA-920 from HORIBA, Ltd., for example.

Colorant

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

The content of the colorant is preferably from 1 to 15% by weight and more preferably from 3 to 10% by weight.

The colorant may be combined with a resin to be used as a master batch. Specific examples of usable resins for the master batch include, but are not limited to, the above-described modified and unmodified polyester resins, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. These compounds can be used alone or in combination.

The master batch may be obtained by mixing and kneading a resin and a colorant while applying a high shearing force. To increase the interaction between the colorant and the resin, an organic solvent may be used. More specifically, the maser batch may be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

Release Agent

Specific examples of usable release agents include, but are not limited to, plant waxes such as carnauba wax, cotton wax, sumac wax, and rice wax; animal waxes such as bees wax and lanolin; mineral waxes such as ozokerite and ceresin; petroleum waxes such as paraffin, microcrystalline, and petrolatum.

Specific examples of usable release agents further include, but are not limited to, synthetic hydrocarbon waxes such as Fischer-Tropsch wax and polyethylene wax; and synthetic waxes of esters, ketones, and ethers.

Specific examples of usable release agents further include, but are not limited to, fatty acid amides such as 1,2-hydroxystearic acid amide, stearic acid amide, phthalic anhydride imide, and chlorinated hydrocarbon; and crystalline polymers (e.g., homopolymers and copolymers of polyacrylates, such as poly-n-stearyl methacrylate and poly-n-lauryl methacrylate, which are low-molecular-weight crystalline polymers) having a long-chain alkyl group on its side chain.

The melting point of the release agent is preferably from 50 to 120° C. and more preferably from 60 to 90° C. Release agents having a melting point less than 50° C. adversely affects heat-resistant storage stability. Release agents having a melting point greater than 120° C. are likely to cause cold offset in low-temperature fixing.

The content of the release agent is preferably 40% by weight or less, more preferably from 3 to 20% by weight, based on the toner.

Charge Controlling Agent

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; LRA-901 and LR-147 (boron complex), which are manufactured by Japan Carlit Co., Ltd.; and copper phthalocyanine, perylene, quinacridone, azo pigments, and polymeric compounds having a functional group such as a sulfonate group, a carboxyl group, and a quaternary ammonium group.

The content of the charge controlling agent is preferably from 0.1 to 10 parts by weight, more preferably from 0.2 to 5 parts by weight, based on 100 parts by weight of the toner. When the content of charge controlling agent exceeds 10 parts by weight, the toner charge is so large that the effect of the main charge controlling agent is reduced and electrostatic attracting force to a developing roller is increased. This may result in decline in developer fluidity and image density.

The charge controlling agent may be first mixed with the master batch or the binder resin and then dissolved or dispersed in an organic solvent, or directly added to an organic solvent at the time of dissolving or dispersing. Alternatively, the charge controlling agent may be fixed on the surface of the resulting toner particles.

External Additive

As an external additive, oxide fine particles, inorganic fine particles, and/or hydrophobized inorganic fine particles can be used. Hydrophobized inorganic fine particles having an average primary particle diameter of from 1 to 100 nm are preferable and those having an average primary particle diameter of from 5 to 70 nm are more preferable.

More preferably, the external additive includes at least one kind of hydrophobized inorganic fine particle having an average primary particle diameter of 20 nm or less and at least one kind of hydrophobized inorganic fine particle having an average primary particle diameter of 30 nm or more.

The BET specific surface area is preferably from 20 to 500 $m^2/g$.

The external additive may include, for example, silica fine particles, hydrophobized silica, metal salts of fatty acids (e.g., zinc stearate, aluminum stearate), metal oxides (e.g., titania, alumina, tin oxide, antimony oxide), and fluoropolymers.

Fine particles of hydrophobized silica, titania, titanium oxide, and alumina are preferred as the external additive. Specific examples of commercially-available silica fine particles include, but are not limited to, R972, R974, RX200, RY200, R202, R805, and R812 (from Nippon Aerosil Co., Ltd.). Specific examples of commercially-available titania fine particles include, but are not limited to, P-25 (from Nippon Aerosil Co., Ltd.); STT-30 and STT-65C-S (from Titan Kogyo, Ltd.); TAF-140 (from Fuji Titanium Industry Co., Ltd.); and MT-150W, MT-500B, MT-600B, and MT-150A (from TAYCA Corporation).

Specific examples of commercially available hydrophobized titanium oxide fine particles include, but are not limited to, T-805 (from Nippon Aerosil Co., Ltd.); STT-30A and STT-65S-S (from Titan Kogyo, Ltd.); TAF-500T and TAF-1500T (from Fuji Titanium Industry Co., Ltd.); MT-100S and MT-100T (from TAYCA Corporation); and IT-S (from Ishihara Sangyo Kaisha, Ltd.).

Hydrophobized fine particles of oxides, silica, titania, and alumina can be obtained by treating fine particles of oxides, silica, titania, and alumina, which are hydrophilic, with a silane coupling agent such as methyltrimethoxysilane, methyltriethoxysilane, and octyltrimethoxysilane. Additionally, silicone-oil-treated oxide fine particles and inorganic fine particles are also preferred which are treated with silicone oils upon application of heat, if needed.

Specific examples of usable silicone oils include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic-modified or methacrylic-modified silicone oil, and α-methylstyrene-modified silicone oil. Specific examples of usable inorganic fine particles include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide are preferable.

The content of the external additive is preferably from 0.1 to 5% by weight, more preferably from 0.3 to 3% by weight, based on the toner.

The average primary particle diameter of the inorganic fine particle is preferably 100 nm or less and more preferably from 3 to 70 nm. When the average primary particle diameter falls below the above-described range, the inorganic fine particle will be embedded in the toner and its functions cannot be effectively exhibited. When the average primary particle diameter exceeds the above-described range, the inorganic fine particle will damage the surface of photoreceptor unevenly.

Fluidity Improving Agent

There is no limit in the material of fluidity improving agent so long as hydrophobicity is improved and deterioration of fluidity and chargeability is prevented even under high-humidity conditions by surface treatment with the material. Specific examples of usable materials include, but are not limited to, silane coupling agents, silylation agents, silane coupling agents having a fluorinated alkyl group, organic titanate coupling agents, aluminum coupling agents, silicone oils, and modified silicone oils. It is preferable that the above-described silica and titanium oxide are surface-treated with the fluidity improving agent to become hydrophobic silica and hydrophobic titanium oxide.

Cleanability Improving Agent

There is no limit in the material of cleanability improving agent so long as residual developer remaining on photoreceptor or primary transfer medium after image transfer is removed by addition of the material to the toner. Specific examples of the cleanability improving agent include, but are not limited to, metal salts of fatty acids (e.g., zinc stearate, calcium stearate) and polymer fine particles prepared by soap-free emulsion polymerization (e.g., polymethyl methacrylate fine particles, polystyrene fine particles). Polymer fine particles having a relatively narrow particle size distribution and a volume average particle diameter of from 0.01 to 1 μm are preferred.

Magnetic Material

Specific examples of usable magnetic materials include, but are not limited to, iron powder, magnetite, and ferrite.

Production Method of Toner

Production method of the toner is not limited to any particular method. Preferably, toner particles are produced by dispersing an oily phase containing the crystalline polyester resin, the amorphous polyester resin, and the colorant in an aqueous medium.

Specifically, it is preferable that toner particles are produced by dissolving or dispersing the compound having an active hydrogen group, the polyester resin having a functional group reactive with the compound having an active hydrogen group, the crystalline polyester resin, the amorphous polyester resin, and the colorant in an organic solvent; dispersing the resulting solution or dispersion in an aqueous medium to prepare a dispersion liquid; allowing the compound having an active hydrogen group to cross-link and/or elongate with the polyester resin having a functional group reactive with the compound having an active hydrogen group in the aqueous medium in the presence of the resin fine particle; and removing the organic solvent from the dispersion liquid. Namely, the above method includes the processes of preparation of aqueous medium, preparation of oily phase containing toner materials, emulsification or dispersion of the toner materials, and removal of organic solvent.

Preparation of Aqueous Medium (Aqueous Phase)

The process of preparation of the aqueous medium involves dispersing the resin fine particle in an aqueous material. The amount of the resin fine particle in the aqueous medium is not limited to any particular value but is preferably from 0.5 to 10% by weight.

Specific examples of the aqueous materials include, but are not limited to, water, water-miscible solvents, and mixtures thereof. These materials can be used alone or in combination.

Among these materials, water is preferable.

Specific examples of the water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone.

Preparation of Oily Phase

The process of preparation of the oily phase containing toner materials involves dissolving or dispersing toner materials including the compound having an active hydrogen group, the polyester resin having a functional group reactive with the compound having an active hydrogen group, the crystalline polyester resin, the amorphous polyester resin, and the colorant in an organic solvent.

There is no limit in the kind of the organic solvent but organic solvents having a boiling point less than 150° C. are preferable because they are easily removable.

Specific examples of the organic solvents having a boiling point less than 150° C. include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination.

Among these solvents, ethyl acetate, toluene, xylene, benzene, methylene chloride, 1,2-dichloroethane, chloroform, and carbon tetrachloride are preferable, and ethyl acetate is more preferable.

Emulsification or Dispersion

The process of emulsification or dispersion involves dispersing the oily phase containing toner materials in the aqueous medium. In the process of emulsification or dispersion, the compound having an active hydrogen group is allowed to elongate and/or cross-link with the polyester resin having a functional group reactive with the compound having an active hydrogen group, producing an adhesive base material.

The adhesive base material may be produced by, for example, emulsifying or dispersing an oily phase containing a polyester resin reactive with an active hydrogen group, such as a polyester prepolymer having an isocyanate group, along with a compound having an active hydrogen group, such as an amine, in the aqueous medium to allow them to elongate and/or cross-link with each other in the aqueous medium; emulsifying or dispersing an oily phase containing toner materials in an aqueous medium to which a compound having an active hydrogen group is added in advance; or emulsifying or dispersing an oily phase containing toner materials in an aqueous medium and then adding a compound having an active hydrogen group thereto to allow them to elongate and/or cross-link with each other at the interfaces between the produced particles and the aqueous medium. In a case in which the elongation and/or cross-linking reaction is caused at the interfaces between the produced particles and the aqueous medium, an urea-modified polyester resin is formed preferentially at the surfaces of resulting toner particles. It is also possible to generate a concentration gradient of the urea-modified polyester in the toner particles.

Reaction conditions, i.e., reaction time and reaction temperature, for producing the adhesive base material are not limited to any particular condition and are determined according to the combination of the compound having an active hydrogen group with the polyester resin having a functional group reactive with the compound having an active hydrogen group.

The reaction time is preferably from 10 minutes to 40 hours and more preferably from 2 to 24 hours.

The reaction temperature is preferably from 0 to 150° C. and more preferably 40 to 98° C.

There is no limit in the method of stably dispersing the polyester resin having a functional group reactive with the compound having an active hydrogen group, such as a polyester prepolymer having an isocyanate group, in the aqueous medium.

One example of the method involves adding the oily phase, prepared by dissolving or dispersing toner materials in a solvent, to the aqueous medium and dispersing therein by means of shearing force.

Specific examples of usable dispersers include, but are not limited to, low-speed shearing type disperser, high-speed shearing type disperser, friction type disperser, high-pressure jet type disperser, and ultrasonic disperser.

Among these dispersers, high-speed shearing type disperser is preferable because it is capable of adjusting particle diameter of dispersing elements (oil droplets) to 2 to 20 μm.

When a high-speed shearing type disperser is used, dispersing conditions such as rotation number, dispersing time, and dispersion temperature are arbitrarily selected.

The rotation number is preferably from 1,000 to 30,000 rpm and more preferably from 5,000 to 20,000 rpm.

The dispersing time is preferably from 0.1 to 5 minutes when the disperser is a batch type.

The dispersing temperature is preferably from 0 to 150° C. and more preferably 40 to 98° C. under increased pressure. Generally, the higher the dispersing temperature, the easier the dispersion.

The amount of the aqueous medium used in the process of emulsification or dispersion is preferably from 50 to 2,000 parts by weight, more preferably from 100 to 1,000 parts by weight, based on 100 parts by weight of the toner materials.

When the used amount of the aqueous medium is less than 50 parts by weight, the dispersed state of the toner materials is poor and toner particles having a desired particle size cannot be obtained. When the used amount of the aqueous medium exceeds 2,000 parts by weight, production cost may arise.

It is preferable that a dispersant is used in the process of emulsification or dispersion for stabilizing dispersing elements (oil droplets) and shaping them into a desired shape as well as narrowing particle size distribution of them.

Specific examples of the dispersant include, but are not limited to, surfactants, poorly-soluble inorganic compound dispersants, and polymeric protection colloids. These materials can be used alone or in combination.

Among these materials, surfactants are preferable.

Specific examples of the surfactants include, but are not limited to, anionic surfactants, cationic surfactants, nonionic surfactants, and ampholytic surfactants.

Specific examples of the anionic surfactants include, but are not limited to, alkylbenzene sulfonate, α-olefin sulfonate, and phosphate.

Specifically, those having a fluoroalkyl group are preferable.

In the elongation and/or cross-linking reaction for producing the adhesive base material, a catalyst can be used.

Specific examples of the catalyst include, but are not limited to, dibutyltin laurate and dioctyltin laurate.

Removal of Organic Solvent

There is no limit in the method of removing the organic solvent from the dispersion liquid (i.e., emulsion slurry). One example of the method involves gradually heating the reaction system to evaporate the organic solvents from oil droplets. Another example of the method involves spraying the dispersion liquid into dry atmosphere to remove the organic solvent from oil droplets.

Upon removal of the organic solvent, mother toner particles are formed. The mother toner particles can be subjected to the processes of washing, drying, and classification. In the classification process, ultrafine particles may be removed by means of cyclone separation, decantation, or centrifugal separation in liquids. Alternatively, the classification process is performed after the mother toner particles are dried.

The mother toner particles may be further mixed with particles of external additive, charge controlling agent, etc. By applying mechanical impulsive force at the time of mixing, the particles of external additive, etc., become less releasable from the surfaces of the mother toner particles.

There is no limit in the method of imparting mechanical impulsive force. One example of the method includes agitating the mixed particles with blades rotating at a high speed. Another example of the method includes accelerating the mixed particles in a high-speed airflow to allow the particles collide with a collision plate.

Such treatments can be performed by, for example, ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Developer

A developer according to an embodiment includes at least a toner, and optionally a carrier and other components.

The toner included in the developer is the above-described toner according to an embodiment.

The developer may be either one-component developer or two-component developer.

Carrier

The carrier is not limited in composition. Preferably, the carrier is composed of a core material and a resin layer covering the core material.

Core Material

The core material is not limited in material.

Manganese-strontium (Mn—Sr) materials having a magnetization of from 50 to 90 emu/g and manganese-magnesium (Mn—Mg) materials having a magnetization of from 50 to 90 emu/g are preferable. For ensuring a proper image density, strong-magnetization materials such as iron powder (having a magnetization of 100 emu/g or more) and magnetite (having a magnetization of from 75 to 120 emu/g) are preferable. Weak-magnetization materials such as copper-zinc (Cu—Zn) materials (having a magnetization of from 30 to 80 emu/g) are preferable for improving image quality because they can be brought into contact with a photoreceptor much weaker when they are in the form of ears. These materials can be used alone or in combination.

The mass average particle diameter (D50) of the core material is preferably from 10 to 200 μm and more preferably from 30 to 100 μm.

When the mass average particle diameter (D50) is less than 10 μm, the amount of ultrafine particles is so large that the magnetization per carrier particle gets lower, causing carrier particle scattering. When the mass average particle diameter (D50) exceeds 200 μm, the specific surface area is lowered to cause toner particle scattering and to lower reproducibility of solid parts in full-color image.

Resin Layer

The resin layer is not limited in material.

Specific examples of usable materials include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidene fluoride-acrylic copolymer, vinylidene fluoride-vinyl fluoride copolymer, tetrafluoroethylene-vinylidene fluoride-non-fluoride monomer terpolymer, and silicone resins. These materials can be used alone or in combination.

Specific examples of the amino resins include, but are not limited to, urea-formaldehyde resin, melamine resin, benzoguanamine resin, urea resin, polyamide resin, and epoxy resin. Specific examples of the polyvinyl resins include, but are not limited to, acrylic resin, polymethyl methacrylate resin, polyacrylonitrile resin, polyvinyl acetate resin, polyvinyl alcohol resin, and polyvinyl butyral resin. Specific examples of the polystyrene resins include, but are not limited to, polystyrene resin and styrene-acrylic copolymer resin. Specific examples of the halogenated olefin resins include, but are not limited to, polyvinyl chloride. Specific examples of the polyester resins include, but are not limited to, polyethylene terephthalate resin and polybutylene terephthalate resin.

The resin layer may include a conductive powder, if necessary. Specific examples of the conductive powders include, but are not limited to, metal powder, carbon black, titanium oxide, tin oxide, and zinc oxide. Preferably, the conductive powder has an average particle diameter of 1 μm or less. When the average particle diameter exceeds 1 μm, it may be difficult to control electric resistivity.

The resin layer can be formed by, for example, dissolving a silicone resin, etc. in a solvent to prepare an application liquid and uniformly applying the application liquid to the surface of the core material by a known application method, followed by drying and baking. Specific examples of the application method include, but are not limited to, dipping method, spray method, and brush application method.

Specific examples of the solvent include, but are not limited to, toluene, xylene, methyl ethyl ketone, methyl isobutyl ketone, cellosolve, and butyl acetate.

Specific examples of the baking method include, but are not limited to, external heating method and internal heating method.

Specific examples of the baking instrument include, but are not limited to, stationary type electric furnace, fluxional type electric furnace, rotary type electric furnace, burner furnace, and instruments equipped with microwave.

The content of the resin layer in the carrier is preferably from 0.01 to 5.0% by weight. When the content is less than 0.01% by weight, it may be impossible to form a uniform resin layer on the surface of the core material. When the content exceeds 5.0% by weight, it may be impossible to obtain uniform carrier particles because the resin layer becomes so thick that carrier particles are agglomerated.

The content of the carrier in the developer is preferably from 90 to 98% by weight and more preferably from 93 to 97% by weight.

The mixing rate of the toner to the carrier in the developer is preferably from 1 to 10.0 parts by weight based on 100 parts by weight of the carrier.

Image Forming Apparatus and Image Forming Method

An image forming apparatus according to an embodiment includes at least an electrostatic latent image bearing member, an electrostatic latent image forming device, a developing device, a transfer device, and a fixing device, and optionally other devices such as a neutralizer, a cleaner, a recycler, and a controller.

An image forming method according to an embodiment includes at least electrostatic latent image forming process, developing process, transfer process, and fixing process, and optionally neutralization process, cleaning process, recycle process, and control process.

The image forming method according an embodiment is preferably performed by the image forming apparatus according to an embodiment. The electrostatic latent image forming process is preferably performed by the electrostatic latent image forming device. The developing process is preferably performed by the developing device. The transfer process is preferably performed by the transfer device. The fixing process is preferably performed by the fixing device. The other processes are preferably performed by the corresponding devices.

Electrostatic Latent Image Forming Process and Electrostatic Latent Image Forming Device The electrostatic latent image forming process is a process in which an electrostatic latent image is formed on an electrostatic latent image bearing member.

The electrostatic latent image bearing member (hereinafter may be referred to as "photoreceptor" or simply "image bearing member") is not limited in material, shape, structure, and size. The shape is preferably a drum-like shape. Specific examples of usable materials include, but are not limited to, inorganic photoreceptors such as amorphous silicon and selenium and organic photoreceptors such as polysilane and phthalopolymethine. Among these materials, amorphous silicon is preferable in terms of long operating life.

An amorphous silicon photoreceptor can be prepared by, for example, heating a support medium to 50 to 400° C. and forming a photosensitive layer consisting of a-Si on the support medium by means of film formation methods such as vacuum deposition method, sputtering method, ion plating method, thermal CVD method, optical CVD method, and plasma CVD method. Among these methods, plasma CVD method, i.e., a method of forming a deposited film of a-Si on a support medium by decomposing a raw material gas by direct current, high-frequency, or microwave glow discharge, is preferable.

An electrostatic latent image can be formed by, for example, charging a surface of the photoreceptor and irradiating the surface with light containing image information by the electrostatic latent image forming device.

The electrostatic latent image forming device includes at least a charging device to charge a surface of the photoreceptor and an irradiator to irradiate the surface of the photoreceptor with light containing image information.

Charging Device

A surface of the photoreceptor can be charged by applying a voltage to the surface of the photoreceptor by the charging device.

Specific examples of the charging device include, but are not limited to, contact chargers equipped with conductive or semiconductive roller, brush, film, or rubber blade and non-contact chargers employing corona discharge such as corotron and scorotron.

In addition, the charging device may be in the form of magnetic brush, fur brush, etc. The shape of the charging device is determined according to the specification and configuration of the image forming apparatus.

When the charging device employs magnetic brush, the charging device may consist of magnetic brush comprised of ferrite particles, such as Zn—Cu ferrite, as charging members, a non-magnetic conductive sleeve to support the particles, and a magnet roll included inside the sleeve.

When the charging device employs fur brush, the charging device may consist of a fur treated with carbon, copper sulfide, metal, or metal oxide to have conductivity wound around or attached to a metal or a cored metal treated to have conductivity.

The charging device is preferably a contact charger that has reduced in amount of generating ozone but is not limited thereto.

Irradiator

The surface of the photoreceptor can be irradiated with light containing image information by the irradiator.

Specific examples of the irradiator include, but are not limited to, various irradiators of radiation optical system type, rod lens array type, laser optical type, and liquid crystal shutter optical type.

Specific examples of light sources in the irradiator include, but are not limited to, fluorescent lamp, tungsten lamp, halogen lamp, mercury lamp, sodium lamp, light-emitting diode (LED), semiconductor laser (LD), and electroluminescence (EL).

For the purpose of emitting light with a desired wavelength band only, filters can be used, such as sharp-cut filter, band-pass filter, near-infrared-cut filter, dichroic filter, interference filter, and color temperature conversion filter.

It is also possible that a back surface of the photoreceptor is irradiated with light containing image information.

Developing Process and Developing Device

The developing process is a process in which the electrostatic latent image is developed into a visible image with a toner or developer.

The toner is the above-described toner according to an embodiment.

The developer is the above-described developer according to an embodiment.

The visible image can be formed by, for example, developing the electrostatic latent image with the toner or developer by the developing device.

The developing device is not limited in configuration so long as the toner or developer is used for development. For example, a developing device capable of storing the toner or developer and directly or indirectly supplying the toner or developer to the electrostatic latent image is preferable.

The developing device may employ either dry developing method or wet developing method. The developing device may be for either monochrome development or multicolor development. For example, a developing device including an agitator to frictionally agitate the toner or developer to charge it and a rotatable magnet roller is preferable.

In such a developing device, the toner and carrier particles are mixed and agitated and the toner particles are charged by friction. The charged toner particles are retained on the surface of the rotating magnet roller in the form of ears, forming magnetic brush. The magnet roller is disposed adjacent to the photoreceptor so that a part of the toner particles composing the magnetic brush formed on the surface of the magnet roller are moved to the surface of the photoreceptor by electric attractive force. As a result, the electrostatic latent image is developed with the toner particles to form a visible image on the surface of the photoreceptor.

Transfer Process and Transfer Device

The transfer process is a process in which the visible image is transferred onto a recording medium. It is preferable that the visible image is primarily transferred onto an intermediate transfer medium and then secondarily transferred onto the recording medium.

The visible image can be transferred by, for example, charging the photoreceptor by the charging device by the transfer device. The transfer device preferably includes a primary transfer device to transfer a visible image onto an intermediate transfer medium to form a composite image and a secondary transfer device to transfer the composite image onto a recording medium.

When a colored image comprised of multiple color toners is to be secondarily transferred onto the recording medium, each color toner is sequentially superimposed on one another on the intermediate transfer medium by the primary transfer device to form a composite image and the composite image is then transferred onto the recording medium at once by the secondary transfer device.

Specific examples of the intermediate transfer medium include, but are not limited to, transfer belt.

The transfer device (the primary and secondary transfer devices) preferably includes a transferrer to separate the visible image formed on the photoreceptor to the recording medium side by charging. The number of the transfer devices is at least one. Specific examples of the transferrer include, but are not limited to, corona transferrer, transfer belt, transfer roller, pressure transfer roller, and adhesive transferrer.

The recording medium is not limited in material so long as a developed image without being fixed can be transferred thereon. Specific examples of the recording medium include, but are not limited to, normal paper and PET base for OHP.

Fixing Process and Fixing Device

The fixing process is a process in which the visible image transferred onto the recording medium is fixed thereon. The fixing process may be performed either every time each color toner is transferred onto the recording medium or at once after all color toners are superimposed on one another.

The fixing process can be performed by the fixing device.

The fixing device is not limited in configuration but preferably includes a heat-pressure member. Specific examples of the heat-pressure member include, but are not limited to, a combination of a heat roller and a pressure roller; and a combination of a heat roller, a pressure roller, and an endless belt.

The heating temperature of the heat-pressure member is normally from 80 to 200° C.

The fixing device may be used together with or replaced with an optical fixer.

The surface pressure is preferably from 10 to 80 N/cm$^2$.

Preferably, the fixing process is performed by a fixing device including a heating element, at least one heat transmitting medium to be heated by the heating element, and a pressure member to press a recording medium against one of the heat transmitting medium, which fixes a toner image on the recording medium by heat.

It is preferable that at least one of the heat transmitting medium is a belt-shaped heat transmitting medium with or without a certain amount of oil applied to its surface.

In this case, specifically, from 0 to 4 mg of oil is applied to the surface of the belt-shaped heat transmitting medium per A4-size area. Namely, no oil may be applied to the surface of the belt-shaped heat transmitting medium.

Figure 2:
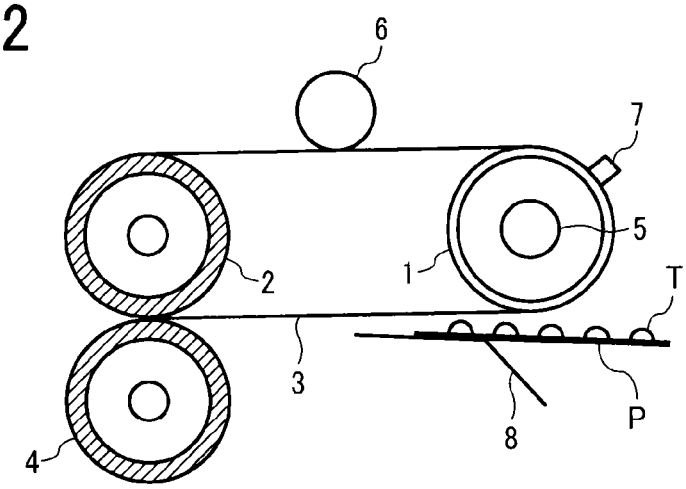
FIG. 2 is a schematic view of a fixing device according to an embodiment.

FIG. 2 is a schematic view of a fixing device according to an embodiment. A numeral 2 denotes a fixing roller consisting of a metallic (e.g., aluminum, iron) cored bar covered with an elastic body (e.g., silicone rubber) and a numeral 1 denotes a heat roller consisting of a metallic hallow cylindrical cored bar (e.g., a pipe of aluminum, iron, copper, stainless steel, etc.) equipped with a heat source 5. A numeral 7 denotes a temperature sensor for measuring a surface temperature of a fixing belt 3 at a point of contact with the heat roller 1. The fixing belt 3 is stretched taut between the fixing roller 2 and the heat roller 1. The fixing belt 3 is small in heat capacity and consists of a base substance (e.g., nickel, polyimide, etc., having a thickness of from 30 to 150 μm) and a release layer (e.g., a silicone rubber having a thickness of from 50 to 300 μm, a fluorine-based resin having a thickness of from 10 to 50 μm) overlaid thereon. A numeral 4 denotes a pressure roller consisting of a metallic cored bar covered with an elastic body. The pressure roller 4 is pressed against the lower side of the fixing roller 2 with the fixing belt 3 therebetween, forming a nip portion between the fixing belt 3 and the pressure roller 4. The size of each member is determined according to various conditional requirements. A numeral 6 denotes an oil application roller, a numeral 8 denotes a guide plate, P denotes a transfer medium, and T denotes a toner on the transfer medium.

Neutralization Process and Neutralizer

The neutralization process is a process in which neutralization bias is applied to the photoreceptor to neutralize the photoreceptor and is preferably performed by a neutralizer.

The neutralizer is not limited in configuration so long as neutralization bias can be applied. Specific examples of the neutralizer include, but are not limited to, neutralization lamp.

Cleaning Process and Cleaner

The cleaning process is a process in which residual toner particles remaining on the photoreceptor are removed and is preferably performed by a cleaner. It is possible that residual toner particles are collected with a developing roller after the charge of the residual toner particles are equalized with a frictioning member without using cleaner.

The cleaner is not limited in configuration so long as residual toner particles remaining on the photoreceptor can be removed. Specific examples of the cleaner include, but are not limited to, magnetic brush cleaner, electrostatic brush cleaner, magnetic roller cleaner, blade cleaner, brush cleaner, and web cleaner.

Recycle Process and Recycler

The recycle process is a process in which the toner particles removed in the cleaning process are recycled by the developing device and is preferably performed by a recycler. The recycler is not limited in configuration. Specific examples of the recycler include, but are not limited to, conveyor.

Control Process and Controller

The control process is a process in which the above-described processes are controlled and is preferably performed by a controller.

The controller is not limited in configuration so long as the above-described processes can be controlled. Specific examples of the controller include, but are not limited to, sequencer and computer.

Preferably, the image forming apparatus is equipped with a process cartridge which integrally supports at least the electrostatic latent image bearing member and the developing device and is detachably attachable to image forming apparatus.

Non-limiting examples of the image forming apparatus according to an embodiment are described below with reference to the drawings.

Figure 3:
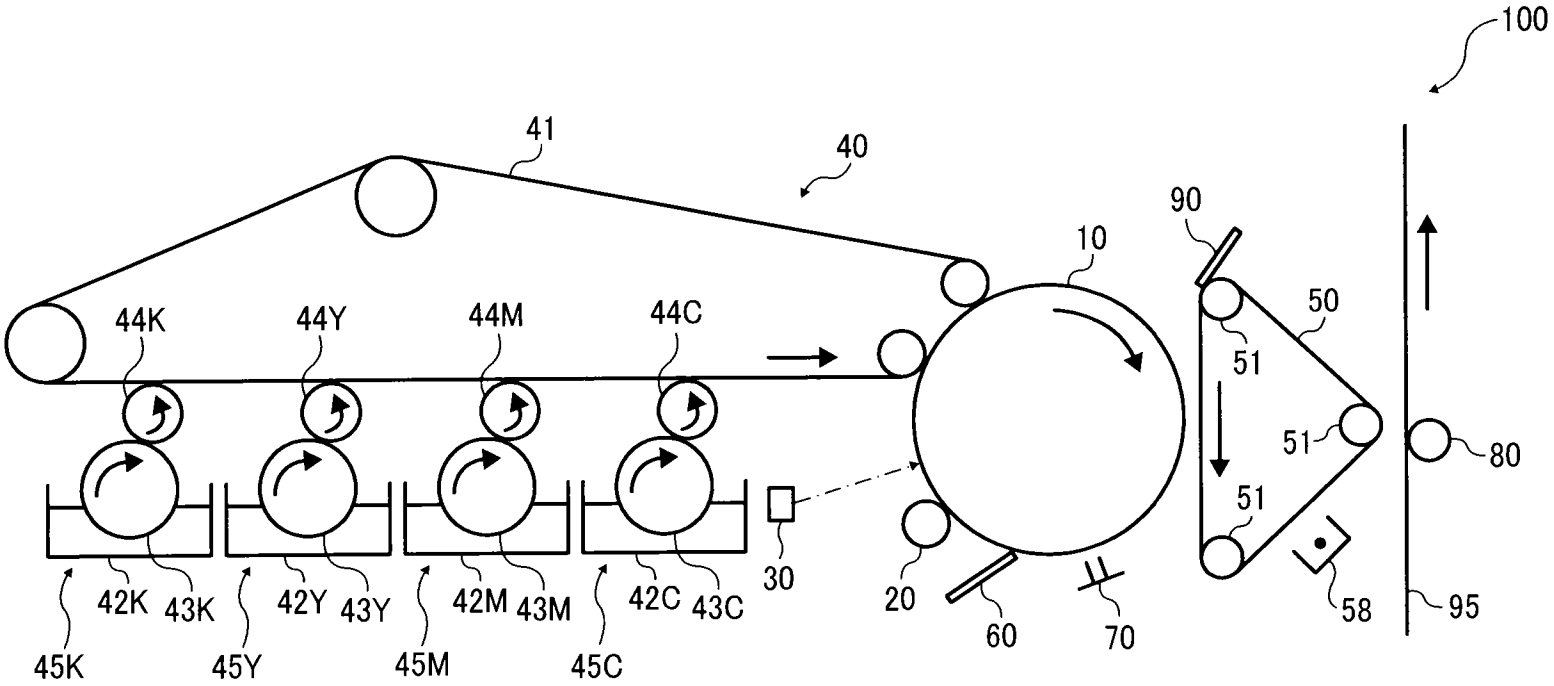
FIG. 3 is a schematic view of an image forming apparatus according to an embodiment.

FIG. 3 is a schematic view of an image forming apparatus according to an embodiment. A full-color image forming apparatus 100 includes a photoreceptor drum 10 (hereinafter "photoreceptor 10") serving as the electrostatic latent image bearing member, a charging roller 20 serving as the charging device, an irradiator 30 serving as the irradiator, a developing device 40 serving as the developing device, an intermediate transfer medium 50, a cleaner 60 equipped with a cleaning blade serving as the cleaner, and a neutralization lamp 70 serving as the neutralization device.

The intermediate transfer medium 50 is in the form of an endless belt and is stretched taut by three rollers 51 disposed inside the loop of the endless belt. The intermediate transfer medium 50 is movable in the direction indicated by arrow in FIG. 3. A part of the three rollers 51 also function(s) as transfer bias roller(s) capable of applying a predetermined transfer bias (primary transfer bias) to the intermediate transfer medium 50. A cleaner 90 equipped with a cleaning blade is disposed adjacent to the intermediate transfer medium 50. A transfer roller 80 serving as the transfer device is disposed facing the intermediate transfer medium 50. The transfer roller 80 is capable of applying transfer bias to a transfer paper 95, serving as the final recording medium, for secondarily transferring a toner image on the transfer paper 95. Around the intermediate transfer medium 50, a corona charger 58 to give charge to a toner image on the intermediate transfer medium 50 is disposed between the contact point of the intermediate transfer medium 50 with the photoreceptor 10 and the contact point of the intermediate transfer medium 50 with the transfer paper 95 relative to the direction of rotation of the intermediate transfer medium 50.

The developing device 40 includes a developing belt 41 serving as a developer bearing member; and a black developing unit 45K, a yellow developing unit 45Y, a magenta developing unit 45M, and a cyan developing unit 45C each disposed around the developing belt 41. The black developing unit 45K contains a developer container 42K, developer supplying roller 43K, and a developing roller 44K. The yellow developing unit 45Y contains a developer container 42Y, developer supplying roller 43Y, and a developing roller 44Y. The magenta developing unit 45M contains a developer container 42M, developer supplying roller 43M, and a developing roller 44M. The cyan developing unit 45C contains a developer container 42C, developer supplying roller 43C, and a developing roller 44C. The developing belt 41 is in the form of an endless belt and rotatably stretched taut by multiple belt rollers. A part of the developing belt 41 is in contact with the photoreceptor 10.

In the full-color image forming apparatus 100 illustrated in FIG. 3, the charging roller 20 uniformly charges the photoreceptor 10. The irradiator 30 irradiates the photoreceptor 10 with light containing image information to form an electrostatic latent image thereon. The electrostatic latent image formed on the photoreceptor 10 is developed into a toner image with toner supplied from the developing device 40. The toner image is transferred primarily onto the intermediate transfer medium 50 by application of voltage from the roller(s) 51 and secondarily onto the transfer paper 95. As a result, a transferred image is formed on the transfer paper 95. Residual toner particles remaining on the photoreceptor 10 are removed by the cleaner 60 and residual charge remaining on the photoreceptor 10 are once removed by the neutralization lamp 70.

Figure 4:
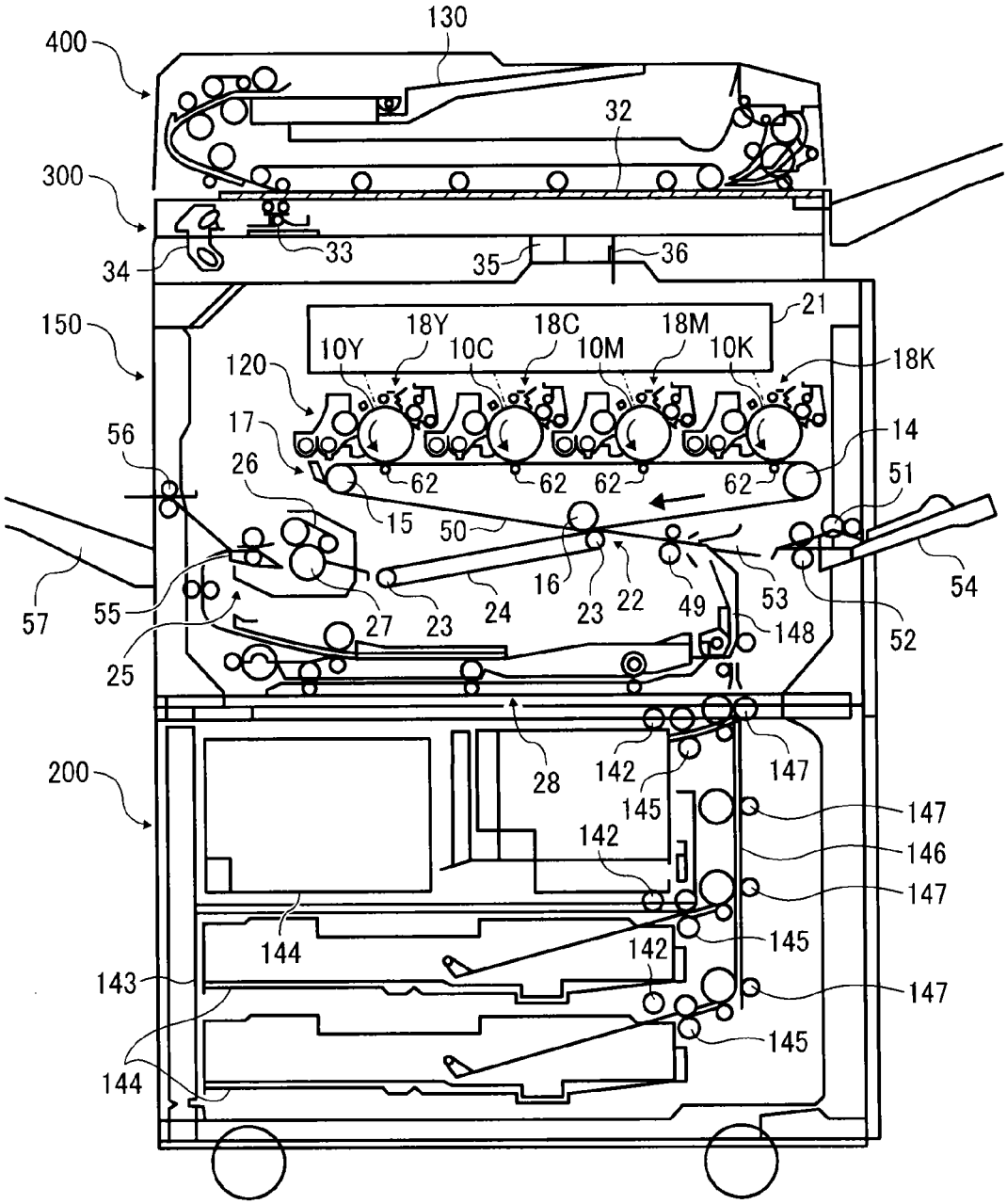
FIG. 4 is a schematic view of an image forming apparatus according to an embodiment.

A full-color image forming apparatus illustrated in FIG. 4 includes a main body 150, a paper feed table 200, a scanner 300, and an automatic document feeder (ADF) 400.

An intermediate transfer member 50 in the form of a seamless belt is disposed at the center of the main body 150.

The intermediate transfer medium 50 is stretched taut with support rollers 14, 15, and 16 and is rotatable clockwise in FIG. 4. An intermediate transfer medium cleaner 17 is disposed adjacent to the support roller 15 to remove residual toner particles remaining on the intermediate transfer medium 50. Image forming units 18Y, 18C, 18M, and 18K to produce respective images of yellow, cyan, magenta, and black are arranged in tandem along a stretched surface of the intermediate transfer medium 50 between the support rollers 14 and 15, constituting a tandem image forming part 120. An irradiator 21 is disposed adjacent to the tandem image forming part 120. A secondary transfer device 22 is disposed on the opposite side of the tandem image forming part 120 relative to the intermediate transfer medium 50. In the secondary transfer device 22, a secondary transfer belt 24 in the form of a seamless belt is stretched taut with a pair of rollers 23. Transfer paper to be conveyed on the secondary transfer belt 24 and the intermediate transfer medium 50 are contactable with each other. A fixing device 25 is disposed adjacent to the secondary transfer device 22. The fixing device 25 consists of a fixing belt 26 in the form of a seamless belt and a pressing roller 27 pressed against the fixing belt 26.

A sheet reversing device 28 is disposed adjacent to the secondary transfer device 22 and the fixing device 25 to reverse a sheet of transfer paper upside down so that images can be formed on both sides of the sheet.

Procedure of full-color image formation (color copy) by the tandem image forming part 120 is described below. A document is set on a document table 130 of the automatic document feeder 400 or on a contact glass 32 of the scanner 300 while the automatic document feeder 400 is lifted up, followed by holding down of the automatic document feeder 400.

As a switch is pressed, in a case in which a document is set on the contact glass 32, the scanner 300 immediately starts driving to run a first runner 33 and a second runner 34. In a case in which a document is set on the automatic document feeder 400, the scanner 300 starts driving after the document is fed onto the contact glass 32. The first runner 33 directs light from a light source to the document and reflects a light reflected from the document toward the second runner 34. A mirror in the second runner 34 reflects the light toward a reading sensor 36 through an imaging lens 35. Thus, the document is read and converted into image information of yellow, cyan, magenta, and black.

Figure 5:
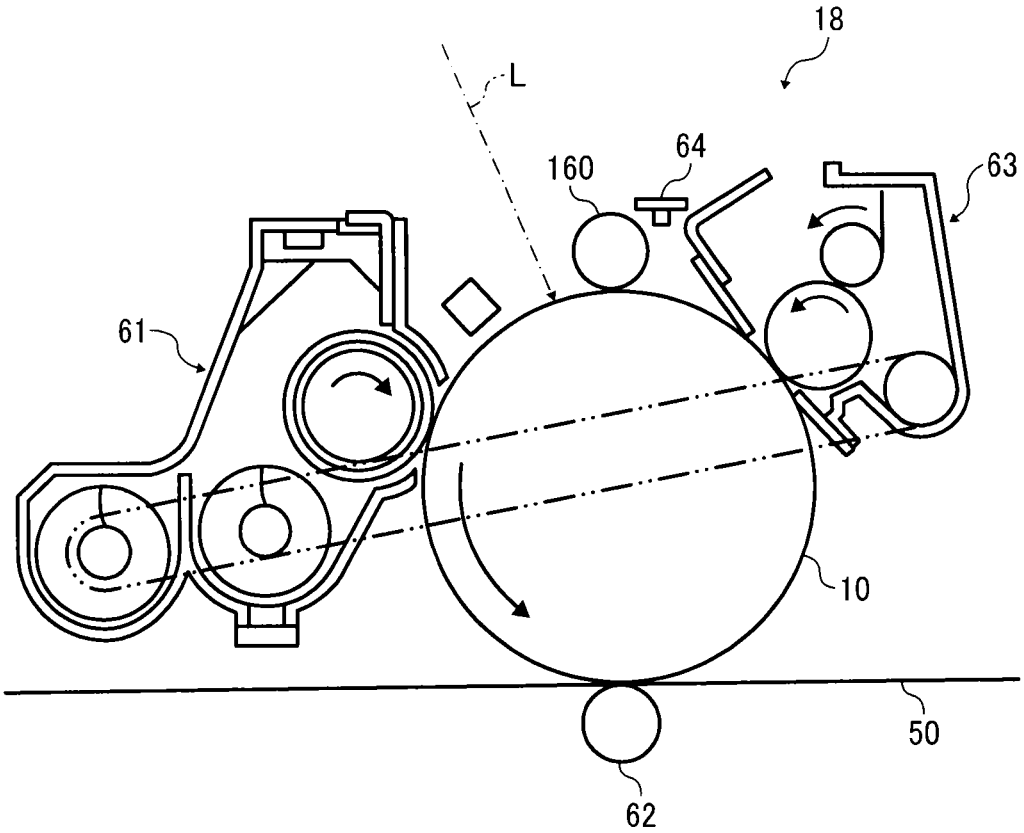
FIG. 5 is a partial magnified view of FIG. 4.

The image information of yellow, cyan, magenta, and black is transmitted to the corresponding image forming units 18Y, 18C, 18M, and 18K in the tandem image forming part 120 so that toner images of yellow, cyan, magenta, and black are formed. FIG. 5 is a magnified schematic view of each of the image forming units 18Y, 18C, 18M, and 18K. In FIG. 5, additional characters Y, C, M, and K representing toner colors of yellow, cyan, magenta, and black, respectively, are omitted for the sake of simplicity. Each of the image forming units 18 includes a photoreceptor 10, a charger 160 to uniformly charge the photoreceptor 10, a developing device 61 to develop an electrostatic latent image formed on the photoreceptor 10 by exposure to light L containing image information with a corresponding color toner to form a toner image, a transfer charger 62 to transfer the toner image onto the intermediate transfer medium 50, a photoreceptor cleaner 63, and a neutralizer 64. The image forming units 18Y, 18C, 18M, and 18K are capable of forming single-color images of yellow, cyan, magenta, and black, respectively, based on corresponding image information. The toner images of yellow, cyan, magenta, and black thus formed on the respective photoreceptors 10Y, 10C, 10M, and 10K are then primarily transferred onto the intermediate transfer medium 50, rotated by the support rollers 14, 15, and 16, in a sequential manner. The toner images of yellow, cyan, magenta, and black are superimposed on one another on the intermediate transfer medium 50, forming a composite full-color toner image.

On the other hand, as the switch is pressed, one of paper feed rollers 142 starts rotating in the paper feed table 200 to feed sheets of recording paper from one of paper feed cassettes 144 in a paper bank 143. One of separation rollers 145 separates the sheets one by one and feeds them to a paper feed path 146. Feed rollers 147 feed each sheet to a paper feed path 148 in the main body 150. The sheet is stopped upon striking a registration roller 49. Alternatively, a feed roller 51 starts rotating to feed sheets from a manual feed tray 54. A separation roller 52 separates the sheets one by one and feeds them to a manual paper feed path 53. The sheet is stopped upon striking the registration roller 49. The registration roller 49 is generally grounded. Alternatively, it is possible that the registration roller 49 is applied with a bias for the purpose of removing paper powders from the sheet.

The registration roller 49 starts rotating to feed the sheet to between the intermediate transfer medium 50 and the secondary transfer device 22 in synchronization with an entry of the composite full-color toner image formed on the intermediate transfer medium 50 thereto. The secondary transfer device 22 then secondarily transfers the composite full-color toner image onto the sheet of recording paper. Residual toner particles remaining on the intermediate transfer medium 50 after image transfer are removed by the intermediate transfer medium cleaner 17.

The secondary transfer device 22 feeds the sheet having the composite full-color image thereon to the fixing device 25. In the fixing device 25, the composite full-color image is fixed on the sheet by heat and pressure. The switch claw 55 switches paper feed paths so that the sheet is discharged by the discharge roller 56 onto the discharge tray 57. Alternatively, the switch claw 55 may switch paper feed paths so that the sheet is introduced into the sheet reversing device 28. In the sheet reversing device 28, the sheet gets reversed and is introduced to the transfer position again to record another image on the back side of the sheet. Thereafter, the sheet is discharged by the discharge roller 56 onto the discharge tray 57.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Synthesis of Amorphous Segment A

A 5-liter four-neck flask equipped with a nitrogen inlet pipe, a dewatering pipe, a stirrer, and a thermocouple is charged with propylene glycol as a diol and dimethyl terephthalate and dimethyl adipate as dicarboxylic acids, with the molar ratio of dimethyl terephthalate to dimethyl adipate being 80/20 and the ratio of OH groups to COOH groups being 1.2, along with titanium tetraisopropoxide in an amount of 300 ppm based on the total weight of the raw materials while methanol is being flowed out.

The mixture is finally heated to 200° C. and subjected to reaction until the acid value of the produced resin becomes 5 mgKOH/g or less.

The mixture is further subjected to reaction under reduced pressures of from 20 to 30 mmHg for 3 hours. Thus, an amorphous segment A, being an amorphous polyester resin, is prepared.

Synthesis of Crystalline Segment C

A 5-liter four-neck flask equipped with a nitrogen inlet pipe, a dewatering pipe, a stirrer, and a thermocouple is charged with 1,12-dodecanediol as a diol and sebacic acid as a dicarboxylic acid, with the ratio of OH groups to COOH groups being 1.1, along with titanium tetraisopropoxide in an amount of 300 ppm based on the total weight of the raw materials. The mixture is subjected to reaction for 10 hours at 150° C., subsequent 5 hours at 200° C., and subsequent 2 hours under reduced pressures of 10 mmHg or less. Thus, a crystalline segment C, being a crystalline polyester resin, is prepared.

Synthesis of Block Copolymer Resin

A 5-liter four-neck flask equipped with a nitrogen inlet pipe, a dewatering pipe, a stirrer, and a thermocouple is charged with 1,600 g of the amorphous segment A and 400 g of the crystalline segment C and is subjected to reduced-pressure drying at 10 mmHg and 60° C. for 2 hours. After releasing nitrogen pressure, 200 g of ethyl acetate having been dewatered with molecular sieves 4A is added to the flask under nitrogen gas flow to uniformly dissolve the resins. After adding 136 g of 4,4'-diphenylmethane diisocyanate to the flask, the reaction system is agitated until it becomes visually uniform. Further, tin 2-ethylhexanoate in an amount of 100 ppm based on the total weight of the resin solid contents is added as a catalyst. The reaction system is heated to 85° C. and subjected to reaction for 8 hours under reflux. Ethyl acetate is distilled away under reduced pressures. Thus, a block copolymer resin is prepared.

Preparation of Crystalline Polyester Resin Dispersion Liquid 1

A 2-liter metallic container is charged with 80 g of the block copolymer resin, 100 g of the crystalline segment C, and 400 g of ethyl acetate. The mixture is heated to 75° C. so that the resins are dissolved in the ethyl acetate and then rapidly cooled at a rate of 27° C./min in an ice bath. After adding 500 mL of glass beads (having a diameter of 3 mm) to the container, the mixture is subjected to pulverization with a batch-type sand mill device (from Kanpe Hapio Co., Ltd.) for 20 hours. Thus, a crystalline polyester resin dispersion liquid 1 is prepared.

Preparation of Crystalline Polyester Resin Dispersion Liquid 2

A 2-liter metallic container is charged with 50 g of the block copolymer resin, 100 g of the crystalline segment C, and 400 g of ethyl acetate. The mixture is heated to 75° C. so that the resins are dissolved in the ethyl acetate and then rapidly cooled at a rate of 27° C./min in an ice bath. After adding 500 mL of glass beads (having a diameter of 3 mm) to the container, the mixture is subjected to pulverization with a batch-type sand mill device (from Kanpe Hapio Co., Ltd.) for 20 hours. Thus, a crystalline polyester resin dispersion liquid 2 is prepared.

Preparation of Crystalline Polyester Resin Dispersion Liquid 3

A 2-liter metallic container is charged with 100 g of the crystalline segment C and 400 g of ethyl acetate. The mixture is heated to 75° C. so that the resin is dissolved in the ethyl acetate and then rapidly cooled at a rate of 27° C./min in an ice bath. After adding 500 mL of glass beads (having a diameter of 3 mm) to the container, the mixture is subjected to pulverization with a batch-type sand mill device (from Kanpe Hapio Co., Ltd.) for 20 hours. Thus, a crystalline polyester resin dispersion liquid 3 is prepared.

Example 1

Production of Toner

Preparation of Resin Particle Dispersion

A reaction vessel equipped with a stirrer and a thermometer is charged with 683 parts of ion-exchange water, 11 parts of an emulsifier (ELEMINOL RS-30 from Sanyo Chemical Industries, Ltd.), 110 parts of styrene, 110 parts of methacrylic acid, and 56 parts of butyl acrylate. The mixture is agitated at a revolution of 800 rpm for 15 minutes, thus preparing a white emulsion. The white emulsion is heated to 75° C. and subjected to a reaction for 4 hours. Further, 30 parts of 1% aqueous solution of ammonium persulfate are added to the emulsion and the mixture is aged at 75° C. for 2 hours. Thus, a resin particle dispersion is prepared.

Synthesis of Unmodified Polyester Resin (Amorphous Polyester Resin)

A 5-liter four-neck flask equipped with a nitrogen inlet pipe, a dewatering pipe, a stirrer, and a thermocouple is charged with 270 parts of ethylene oxide 2 mol adduct of bisphenol A, 480 parts of propylene oxide 3 mol adduct of bisphenol A, 158 parts of terephthalic acid, 50 parts of adipic acid, and 2 parts of dibutyltin oxide. The mixture is subjected to reaction at 210° C. for 10 hours under normal pressures and subsequent 5 hours under reduced pressures of from 10 to 15 mmHg. After adding 35 parts of trimellitic anhydride to the flask, the mixture is further subjected to reaction at 180° C. for 3 hours under normal pressures. Thus, an unmodified polyester resin is prepared. The unmodified polyester resin has a Tg of 49° C.

Synthesis of Polyester Prepolymer

A reaction vessel equipped with a condenser, a stirrer, and a nitrogen inlet pipe is charged with 229 parts of ethylene oxide 2 mol adduct of bisphenol A, 329 parts of propylene oxide 2 mol adduct of bisphenol A, 208 parts of terephthalic acid, 30 parts of trimellitic anhydride, and 2 parts of dibutyltin oxide. The mixture is subjected to a reaction at 200° C. for 10 hours under normal pressures and subsequent 5 hours under reduced pressures of from 10 to 15 mmHg. Thus, an intermediate polyester 1 is prepared.

Another reaction vessel equipped with a condenser, a stirrer, and a nitrogen inlet pipe is charged with 410 parts of the intermediate polyester, 89 parts of isophorone diisocyanate, and 500 parts of ethyl acetate. The mixture is subjected to a reaction for 7 hours at 100° C. Thus, a prepolymer is prepared.

The prepolymer includes 1.3% by weight of free isocyanates.

Synthesis of Ketimine Compound

A reaction vessel equipped with a stirrer and a thermometer is charged with 170 parts of isophoronediamine and 75 parts of methyl ethyl ketone. The mixture is subjected to a reaction for 5 hours at 50° C. Thus, a ketimine compound is prepared.

The ketimine compound has an amine value of 418.

Preparation of Master Batch

Water in an amount of 1,200 parts, a carbon black (PRINTEX 35 from Degussa having a DBP oil absorption of 42 mL/100 mg and a pH of 9.5) in an amount of 540 parts, the block copolymer resin in an amount of 300 parts, the crystalline segment C in an amount of 1,200 parts, and the unmodified polyester resin in an amount of 1,200 parts are mixed with a HENSCHEL MIXER. The mixture is kneaded with a double roll at 130° C. for 1 hour, cooled by rolling, and then pulverized. Thus, a master batch is prepared.

Preparation of Oily Phase

A reaction vessel equipped with a stirrer and a thermometer is charged with 95 parts of the unmodified polyester resin, 110 parts of a paraffin wax (HNP-51 from Nippon Seiro Co., Ltd.), 22 parts of a charge controlling agent (a metal complex of salicylic acid E-84 from Orient Chemical Industries Co., Ltd.), and 947 parts of ethyl acetate. The mixture is heated to 80° C. under agitation, kept at 80° C. for 5 hours, and cooled to 30° C. over a period of 1 hour. The mixture is further mixed with 500 parts of the master batch and 500 parts of ethyl acetate for 1 hour. Thus, a raw material liquid is prepared.

Thereafter, 1,324 parts of the raw material liquid are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes).

Further, 522 parts of a 65% ethyl acetate solution of the unmodified polyester resin are added and the resulting mixture is subjected to the above dispersing operation 1 times (1 pass). Thus, a colorant wax dispersion is prepared. The solid content concentration in the colorant wax dispersion is 50% (130° C., 30 minutes).

Preparation of Aqueous Phase

An aqueous phase is prepared by mixing 990 parts of water, 80 parts of the resin particle dispersion, 37 parts of a 48.5% aqueous solution of dodecyl diphenyl ether sodium disulfonate (ELEMINOL MON-7 from Sanyo Chemical Industries, Ltd.), and 90 parts of ethyl acetate. The aqueous phase is a milky whitish liquid.

Emulsification/Shape Control/Solvent Removal

A vessel is charged with 332 parts of the colorant wax dispersion, 4.6 parts of the ketimine compound, and 65 parts of the prepolymer. The mixture is agitated by a TK HOMOMIXER (from PRIMIX Corporation) at a revolution of 5,000 rpm for 30 minutes. Further, 1,200 parts of the aqueous phase are added to the vessel and the mixture is agitated by a TK HOMOMIXER at a revolution of 13,000 rpm for 20 minutes. Thus, an emulsion slurry is prepared.

The emulsion slurry is contained in a vessel equipped with a stirrer and a thermometer and subjected to solvent removal for 8 hours at 30° C. and subsequent aging for 7 hours at 45° C. Thus, a dispersion slurry is prepared.

Washing and Drying

After 100 parts of the dispersion slurry are filtered under reduced pressures, the resulting wet cake is mixed with 100 parts of ion-exchange water using a TK HOMOMIXER for 10 minutes at a revolution of 12,000 rpm, followed by filtering, thus obtaining a wet cake (1).

The wet cake (1) is mixed with 100 parts of 10% aqueous solution of sodium hydroxide using a TK HOMOMIXER for 30 minutes at a revolution of 12,000 rpm, followed by filtering under reduced pressures, thus obtaining a wet cake (2).

The wet cake (2) is mixed with 100 parts of 10% hydrochloric acid using a TK HOMOMIXER for 10 minutes at a revolution of 12,000 rpm, followed by filtering, thus obtaining a wet cake (3).

The wet cake (3) is mixed with 300 parts of ion-exchange water using a TK HOMOMIXER for 10 minutes at a revolution of 12,000 rpm, followed by filtering. This operation is repeated twice, thus obtaining a wet cake (4).

The wet cake (4) is dried by a circulating air dryer for 48 hours at 45° C. and then filtered with a mesh having openings of 75 μm. Thus, a mother toner particle is prepared.

Reheating

The mother toner particle is heated at 50° C. for 24 hours.

Mixing of External Additive

The mother toner particle having been reheated in an amount of 100 parts is mixed with 1.0 part of a hydrophobized silica and 0.3 parts of a hydrophobized titanium oxide by a HENSCHEL MIXER. Thus, a toner is prepared.

Preparation of Carrier

A ferrite carrier having a silicone resin coating with an average thickness of 0.5 μm and an average particle diameter of 35 μm is prepared as follows.

| Core Material | |
|---|---|
| Mn ferrite particle (having a weight average particle diameter of 35 μm) | 5,000 parts |
| **Coating materials** | |
| Toluene | 450 parts |
| Silicone resin (SR2400 from Dow Corning Toray Co., Ltd., including 50% of non-volatile contents) | 450 parts |
| Aminosilane (SH6020 from Dow Corning Toray Co., Ltd.) | 10 parts |
| Carbon black | 10 parts |

The above coating materials are subjected to a dispersion treatment with a stirrer for 10 minutes to prepare a coating liquid. The coating liquid and the core material are put into a coating machine, which contains a fluidized bed equipped with a rotary bottom disc and agitation blades configured to generate swirling flow, to apply the coating liquid to the core material. The core material having been applied with the coating liquid is burnt in an electric furnace at 250° C. for 2 hours. Thus, a carrier is prepared.

Preparation of Two-Component Developer

Each toner in an amount of 7 parts is uniformly mixed with and charged by the above-prepared ferrite carrier, having an average particle diameter of 35 μm, in an amount of 100 parts by a TURBULA MIXER that causes agitation by rolling motion. Thus, a two-component developer is prepared.

Example 2

The procedure for preparing toner in Example 1 is repeated except for changing the amount of the block copolymer resin used in the process of preparation of master batch to 480 parts, thus obtaining a toner and a developer. Conditions for preparing toner are summarized in Table 1.

The toner and developer are subject to evaluations in the same manner as Example 1. The results are shown in Table 2.

Example 3

The procedure for preparing toner in Example 1 is repeated except that the block copolymer resin and the crystalline segment C are not added in the process of preparation of master batch while 150 parts of the crystalline polyester resin dispersion liquid 1 is added in the process of emulsification, shape control, and solvent removal, thus obtaining a toner and a developer. Conditions for preparing toner are summarized in Table 1.

The toner and developer are subject to evaluations in the same manner as Example 1. The results are shown in Table 2.

Example 4

The procedure for preparing toner in Example 1 is repeated except for changing the amount of the block copolymer resin used in the process of preparation of master batch to 480 parts and the heating time in the reheating process to 36 hours, thus obtaining a toner and a developer. Conditions for preparing toner are summarized in Table 1.

The toner and developer are subject to evaluations in the same manner as Example 1. The results are shown in Table 2.

Example 5

The procedure for preparing toner in Example 1 is repeated except that the block copolymer resin and the crystalline segment C are not added in the process of preparation of master batch while 150 parts of the crystalline polyester resin dispersion liquid 1 is added in the process of emulsification, shape control, and solvent removal, and the heating time in the reheating process is changed to 36 hours, thus obtaining a toner and a developer. Conditions for preparing toner are summarized in Table 1.

The toner and developer are subject to evaluations in the same manner as Example 1. The results are shown in Table 2.

Example 6

The procedure for preparing toner in Example 1 is repeated except for changing the heating time in the reheating process to 48 hours, thus obtaining a toner and a developer. Conditions for preparing toner are summarized in Table 1.

The toner and developer are subject to evaluations in the same manner as Example 1. The results are shown in Table 2.

Comparative Example 1

The procedure for preparing toner in Example 1 is repeated except that the block copolymer resin and the crystalline segment C are not added in the process of preparation of master batch while 150 parts of the crystalline polyester resin dispersion liquid 2 is added in the process of emulsification, shape control, and solvent removal, thus obtaining a toner and a developer. Conditions for preparing toner are summarized in Table 1.

The toner and developer are subject to evaluations in the same manner as Example 1. The results are shown in Table 2.

Comparative Example 2

The procedure for preparing toner in Example 1 is repeated except that the block copolymer resin and the crystalline segment C are not added in the process of preparation of master batch while 150 parts of the crystalline polyester resin dispersion liquid 3 is added in the process of emulsification, shape control, and solvent removal, and the heating time in the reheating process is changed to 48 hours, thus obtaining a toner and a developer. Conditions for preparing toner are summarized in Table 1.

The toner and developer are subject to evaluations in the same manner as Example 1. The results are shown in Table 2.

Comparative Example 3

The procedure for preparing toner in Example 1 is repeated except for changing the amount of the block copolymer resin used in the process of preparation of master batch to 480 parts and the heating temperature and time in the reheating process to 80° C. and 1 hour, respectively, thus obtaining a toner and a developer. Conditions for preparing toner are summarized in Table 1.

The toner and developer are subject to evaluations in the same manner as Example 1. The results are shown in Table 2.

Comparative Example 4

The procedure for preparing toner in Example 1 is repeated except for changing the heating temperature and time in the reheating process to 80° C. and 1 hour, respectively, thus obtaining a toner and a developer. Conditions for preparing toner are summarized in Table 1.

The toner and developer are subject to evaluations in the same manner as Example 1. The results are shown in Table 2.

TABLE 1

| | Reheating Process | | Use of Crystalline |
|---|---|---|---|
| | Temperature (° C.) | Time (hr) | Resin in Master Batch Preparation Process |
| Example 1 | 50 | 24 | Yes |
| Example 2 | 50 | 24 | Yes |
| Example 3 | 50 | 24 | No |
| Example 4 | 50 | 36 | Yes |
| Example 5 | 50 | 36 | No |
| Example 6 | 50 | 48 | Yes |
| Comparative Example 1 | 50 | 24 | No |
| Comparative Example 2 | 50 | 48 | No |
| Comparative Example 3 | 80 | 1 | Yes |
| Comparative Example 4 | 80 | 1 | Yes |

Evaluations

Low-Temperature Fixability

A solid image including 0.85±0.1 mg/cm$^2$ of toner is produced by a copier MF2200 (from Ricoh Co., Ltd.) employing TEFLON roller as the fixing roller, the fixing part of which has been modified, on multiple sheets of a paper TYPE 6000 (from Ricoh Co., Ltd.).

Each solid image is fixed on each sheet at a different fixing temperature. The fixed image is scratched with a needle-shaped substance and then rubbed with a cloth. The degree of detachment of the image is evaluated and graded into 5 ranks as follows.

Rank 5: 0% of the image is detached

Rank 4: 1 to 10% of the image is detached

Rank 3: 11 to 30% of the image is detached

Rank 2: 31 to 80% of the image is detached

Rank 1: 81 to 100% of the image is detached

Among the fixing temperatures having delivered the image rank of 4 or more, the lowest fixing temperature is regarded as the minimum fixable temperature.

In the fixing, the paper feed linear speed is 282 mm/sec, surface pressure is 37 N/cm$^2$, and nip width is 3 mm.

The minimum fixable temperature is evaluated according to the following criteria. The results are shown in Table 2.

A: 90° C. or less

B: more than 90° C. and not more than 110° C.

C: more than 110° C. and not more than 120° C.

D: more than 120° C.

Heat-Resistant Storage Stability

Toner in an amount of 20 g is weighed in a 50-mL vial. The vial is left in a thermostatic chamber at 40° C. and 70% RH with its lid open for 1 month and then as it stands for 15 minutes or more. The toner is put on a sieve (having an opening of 75 μm and a wire diameter of 50 μm). An edge of the sieve is tapped with a driver at an amplitude of 7 cm and a speed of 2 time/sec while the sieve is rotating so as to vibrate the sieve. The vibration allows the toner to pass through the sieve. The time limit for vibration is set to 10 minutes. If it takes more than 10 minutes for a toner to completely pass through the sieve, such a toner is regarded as being not evaluable. Heat-resistant storage stability is evaluated by the weight of soft aggregates remaining on the sieve according to the followed criteria. The results are shown in Table 2.

A: The weight of soft aggregates is less than 1 mg/g.

B: The weight of soft aggregates is not less than 1 mg/g and less than 10 mg/g.

C: The weight of soft aggregates is not less than 10 mg/g and less than 50 mg/g.

D: Not evaluable. (Not completely pass through the sieve.)

Gloss Unevenness

A solid image including 0.85±0.1 mg/cm$^2$ of toner is produced by a copier MF2200 (from Ricoh Co., Ltd.) employing TEFLON roller as the fixing roller, the fixing part of which has been modified, on a sheet of a paper TYPE 6000 (from Ricoh Co., Ltd.). Twenty portions or more within the image are subjected to measurement of gloss to calculate a coefficient of variation (standard deviation/average value). The coefficient of variation of gloss is graded into 4 ranks as follows. The results are shown in Table 2.

A: less than 3%

B: not less than 3% and less than 10%

C: not less than 10% and less than 20%

D: not less than 20%

Table 2

| | Coefficient of Variation in Softening Temperature (%) | Length of Long Axis of Crystalline Resin Portion (nm) | DSC Endothermic Quantity (J/g) | Low-temperature Fixability | Heat-resistant Storage Stability | Gloss Unevenness |
|---|---|---|---|---|---|---|
| Example 1 | 11.3 | 226 | 5.2 | B | B | C |
| Example 2 | 7.1 | 295 | 5.3 | B | A | B |
| Example 3 | 9.2 | 271 | 5.7 | B | B | B |

-continued

| | Coefficient of Variation in Softening Temperature (%) | Length of Long Axis of Crystalline Resin Portion (nm) | DSC Endothermic Quantity (J/g) | Low-temperature Fixability | Heat-resistant Storage Stability | Gloss Unevenness |
|---|---|---|---|---|---|---|
| Example 4 | 6.6 | 149 | 13.4 | A | A | A |
| Example 5 | 14.8 | 136 | 13.3 | A | C | C |
| Example 6 | 8.8 | 52 | 7.1 | B | B | B |
| Comparative Example 1 | 16.2 | 272 | 4.4 | B | D | D |
| Comparative Example 2 | 21 | 106 | 13.3 | A | D | C |
| Comparative Example 3 | 4.4 | 353 | 13.7 | D | A | C |
| Comparative Example 4 | 9 | 318 | 13.2 | C | C | C |

The evaluation results for Examples 1 to 6 and Comparative Examples 1 to 4 indicate that the toners according to some embodiments of the invention have excellent low-temperature fixability and heat-resistant storage stability and are capable of forming high-quality image.

Having excellent low-temperature fixability and heat-resistant storage stability, the toners according to some embodiments of the invention are effective for energy saving and preferable for use in high-quality image formation. Developers and image forming apparatuses using the toner according to an embodiment of the invention are also effective for energy saving and preferable for use in high-quality image formation.

What is claimed is:

1. A toner, comprising toner particles which comprise:

an amorphous resin; and a crystalline resin; and further comprise a block copolymer resin comprising:

an amorphous polyester unit (A); and a crystalline polyester unit (C), wherein a coefficient of variation in softening temperature among resin portions in the toner particles is 0.15 or less, the softening temperature being measured with a scanning probe microscope equipped with a heatable cantilever, and wherein the block copolymer resin has urethane and/or urea bonds.

2. The toner according to claim 1, wherein an average length of the long axis of each crystalline resin portion in each toner particle is from 50 to 300 nm.

3. The toner according to claim 1, wherein an endothermic quantity of the crystalline resin is from 5 to 15 J/g.

4. The toner according to claim 1, wherein the coefficient of variation in softening temperature among the resin portions in the toner particles is 0.10 or less.

5. The toner according to claim 1, wherein a mass ratio ((A)/(C)) of the amorphous polyester unit (A) to the crystalline polyester unit (C) is from 90/10 to 60/40.

6. The toner according to claim 1, wherein the toner is manufactured by a dissolution suspension method.

7. A developer, comprising the toner according to claim 1.

* * * * *